US011866878B2

(12) United States Patent
Jung et al.

(10) Patent No.: US 11,866,878 B2
(45) Date of Patent: Jan. 9, 2024

(54) LAUNDRY TREATING APPARATUS

(71) Applicant: LG Electronics Inc., Seoul (KR)

(72) Inventors: Sungwoon Jung, Seoul (KR); Hyehyun Sim, Seoul (KR); Hunjun Jang, Seoul (KR)

(73) Assignee: LG Electronics Inc., Seoul (KR)

( * ) Notice: Subject to any disclaimer, the term of this patent is extended or adjusted under 35 U.S.C. 154(b) by 37 days.

(21) Appl. No.: 17/484,781

(22) Filed: Sep. 24, 2021

(65) Prior Publication Data

US 2022/0098783 A1 Mar. 31, 2022

(30) Foreign Application Priority Data

Sep. 25, 2020 (KR) ..... 10-2020-0124477

(51) Int. Cl.
*D06F 39/02* (2006.01)
*D06F 23/02* (2006.01)
*D06F 39/12* (2006.01)

(52) U.S. Cl.
CPC ..... *D06F 39/028* (2013.01); *D06F 23/02* (2013.01); *D06F 39/12* (2013.01)

(58) Field of Classification Search
CPC ..... D06F 34/10
See application file for complete search history.

(56) References Cited

U.S. PATENT DOCUMENTS 3,658,394 A 4/1972 Gutner
2004/0119388 A1 6/2004 Huang
2012/0167637 A1 7/2012 Mun et al.
2014/0091112 A1 4/2014 Kim
2020/0232145 A1 7/2020 Jung et al.

FOREIGN PATENT DOCUMENTS

| | | |
|---|---|---|
| CN | 202744828 | 2/2013 |
| EP | 2379793 | 10/2011 |
| EP | 2617888 | 7/2013 |
| WO | WO2010076206 | 7/2010 |

OTHER PUBLICATIONS

Extended European Search Report in European Appln. No. 21198631.0, dated Feb. 18, 2022, 10 pages.

*Primary Examiner* — Jason Y Ko
(74) *Attorney, Agent, or Firm* — Fish & Richardson P.C.

(57) ABSTRACT

A laundry treating apparatus includes a cabinet, a tub, a drum, a storage including a storage frame having a detergent storage space defined therein for storing detergent to be supplied to the tub therein, where the storage is retracted into or extended out of the cabinet through a detergent opening, and a fixing assembly disposed inside the cabinet to face the storage, where the fixing assembly includes a fastening elastic portion protruding toward the storage. The storage frame includes a frame outer wall for forming an outer wall of the storage frame and surrounding the detergent storage space, and a frame partition wall disposed in the storage frame to partition the detergent storage space. The frame partition wall includes a fastening protrusion protruding toward the fixing assembly, and the fastening elastic portion is pressurized and elastically deformed by the fastening protrusion during the retraction and the extension of the storage.

20 Claims, 15 Drawing Sheets

LAUNDRY TREATING APPARATUS

CROSS-REFERENCE TO RELATED APPLICATIONS

This application claims the benefit of Korean Patent Application No. 10-2020-0124477, filed on Sep. 25, 2020, which is hereby incorporated by reference as if fully set forth herein.

TECHNICAL FIELD

The present disclosure relates to a laundry treating apparatus, and to a laundry treating apparatus having a detergent feeder.

BACKGROUND

A laundry treating apparatus is an apparatus that puts clothes, bedding, and the like (hereinafter, referred to as laundry) into a drum to remove contamination from the laundry. The laundry treating apparatus may perform processes such as washing, rinsing, dehydration, drying, and the like. The laundry treating apparatuses may be classified into a top loading type laundry treating apparatus and a front loading type laundry treating apparatus based on a scheme of putting the laundry into the drum.

The laundry treating apparatus may include a cabinet forming an appearance of the laundry treating apparatus, a tub accommodated in the cabinet, a drum that is rotatably mounted inside the tub and into which the laundry is put, and a detergent feeder that supplies detergent into the drum.

When the drum is rotated by a motor while wash water is supplied to the laundry accommodated in the drum, dirt on the laundry may be removed by friction with the drum and the wash water.

The detergent feeder has a detergent supply function to enhance a washing effect. In this connection, the detergent refers to a substance that enhances the washing effect, such as fabric detergent, fabric softener, fabric bleach, and the like. Detergent in a powder form and detergent in a liquid form may be used.

Related document KR 10-2020-0091245 discloses a detergent feeder constituting a laundry treating apparatus. The laundry treating apparatus according to the prior art document includes a tub installed inside a main body, a drum installed inside the tub, and a detergent feeder that supplies laundry detergent to the tub, and is installed so as to be retracted into and extended from a front surface of the main body. In addition, the detergent feeder includes a housing forming an appearance of the detergent feeder, a storage container that is extended in a front and rear direction of the main body, stores the laundry detergent, and is mounted in the housing, and a laundry detergent pump that is installed on one side of the storage container, sucks the laundry detergent stored in the storage container, and discharges the laundry detergent downward of the housing.

In the detergent feeder disclosed in the prior are document, the storage container in which the detergent is stored, and the housing that accommodates the storage container therein and is retracted into and extended from the main body are separate components that may be separated from each other.

SUMMARY

Embodiments of the present disclosure are intended to provide a laundry treating apparatus that may effectively improve convenience of a user by securing a detergent storage capacity of a storage.

In addition, embodiments of the present disclosure are intended to provide a laundry treating apparatus that may effectively improve usability based on retraction and extension of a storage.

In addition, embodiments of the present disclosure are intended to provide a laundry treating apparatus that may provide convenience to a user in processes of retraction and extension of a storage.

In addition, embodiments of the present disclosure are intended to provide a laundry treating apparatus that may allow a user to easily recognize whether a storage is coupled in processes of retraction and extension of the storage.

To solve the above-described problems, one embodiment of the present disclosure may provide a detergent storage space for storing detergent directly in a storage frame that forms an appearance of a storage without storing the detergent using a separate detergent reservoir in the storage in a detergent feeder. A capacity of the stored detergent may be increased by removing the detergent reservoir.

In addition, a fastening protrusion may be disposed on a frame partition wall that divides a detergent storage space, and a fastening elastic portion constructed to press a fastening protrusion may be disposed in a fixing assembly facing a storage to secure a detergent storage space to the maximum, and at the same time, to easily recognize by an elastic support force of the fastening elastic portion whether the storage is coupled while a user is retracting or extending the storage.

According to an aspect of the present disclosure, provided is a laundry treating apparatus including a cabinet having a detergent opening defined a front surface thereof, a tub located inside the cabinet and storing wash water therein, a drum rotatably disposed inside the tub and storing laundry therein, a storage including a storage frame having a detergent storage space defined therein for storing detergent to be supplied to the tub therein, wherein the storage is retracted into or extended out of the cabinet through the detergent opening, and a fixing assembly disposed inside the cabinet to face the storage, wherein the fixing assembly includes a fastening elastic portion protruding toward the storage, wherein the storage frame includes a frame outer wall for forming an outer wall of the storage frame and surrounding the detergent storage space, and a frame partition wall disposed in the storage frame to partition the detergent storage space, wherein the frame partition wall includes a fastening protrusion protruding toward the fixing assembly, wherein the fastening elastic portion is pressurized and elastically deformed by the fastening protrusion during the retraction and the extension of the storage.

In one implementation, the frame outer wall may include a front outer wall positioned on a front surface of the storage frame, and a rear outer wall positioned on a rear surface of the storage frame, and the frame partition wall may connect the front outer wall and the rear outer wall to each other. The detergent storage space may be partitioned in a front and rear direction by the frame partition wall, so that various types of detergent may be stored in the partitioned spaces.

In one implementation, the frame partition wall may include an auxiliary storage partition wall spaced apart from the frame outer wall and surrounding a portion of the detergent storage space, a front partition wall for connecting the front outer wall and the auxiliary storage partition wall to each other, and a rear partition wall for connecting the rear outer wall and the auxiliary storage partition wall to each other, and the fastening protrusion may be disposed on the rear partition wall. As the fastening protrusion is formed on the rear partition wall, it is possible to prevent excessive interference of the fastening elastic portion during the retraction and extension of the storage.

In one implementation, the fastening protrusion may be constructed such that a rear end thereof is connected to the rear outer wall, and may be connected to and formed integrally with the rear outer wall to improve durability of the fastening protrusion.

In one implementation, the fastening protrusion may include a front contact portion disposed at a front portion of the fastening protrusion and having a rear end protruding to be higher than a front end to form an inclined surface, a rear contact portion disposed at a rear portion of the fastening protrusion and protruding so as to be in contact with the fastening elastic portion, and a maximally protruding portion for connecting the front contact portion and the rear contact portion to each other, wherein the maximally protruding portion includes a maximally protruding point of the fastening protrusion protruding toward the fixing assembly.

In one implementation, a maximally protruding point of the fastening elastic portion protruding toward the storage may be located forwardly of the maximally protruding portion to support the fastening protrusion while the storage is fully retracted into the cabinet. A coupling strength may be improved by using the elastic force, and a feeling of retracting the storage of the user may be improved.

In one implementation, the rear contact portion may include a horizontal extension section where a height protruding from the rear partition wall is uniform along a longitudinal direction. By the horizontal extension section, the elastic force of the fastening elastic portion may be rapidly changed during the retraction and extension of the storage, and the user may more easily detect whether the storage is retracted or extended.

In one implementation, a rear surface of the rear contact portion may extend from a rear surface of the rear outer wall. Because the fastening protrusion is formed integrally with the rear outer wall, durability of the fastening protrusion may be increased.

In one implementation, the frame outer wall may further include a first side outer wall and a second side outer wall for connecting the front outer wall and the rear outer wall to each other, and the detergent storage space may include a first storage space defined between the first side outer wall and the frame partition wall, a second storage space defined between the second side outer wall and the frame partition wall, and a third storage space surrounded by the auxiliary storage partition wall. User convenience may be improved by separately storing various detergents in the separate divided detergent storage spaces.

In one implementation, the laundry treating apparatus may further include a first cover for shielding an open top surface of the first storage space, a second cover for shielding an open top surface of the second storage space, a first seat portion extending along a perimeter of the first storage space, and coupled to the first cover, and a second seat portion extending along a perimeter of the second storage space, and coupled to the second cover. The open top surfaces of the first storage space and the second storage space may be shielded to prevent the stored detergent from leaking.

In one implementation, the first seat portion and the second seat portion may extend to be spaced apart from each other along the rear partition wall, and the fastening protrusion may be located between the first seat portion and the second seat portion. The first seat portion and the second seat portion are formed separately to improve a coupling force of the first cover and the second cover, and the fastening protrusion may be formed in a space between the first seat portion and the second seat portion to improve space utilization and increase detergent storage capacity.

In one implementation, the first seat portion and the second seat portion may extend to be spaced apart from each other along the front partition wall and the rear partition wall, and a spacing distance between the first seat portion and the second seat portion may be greater on the rear partition wall than on the front partition wall. The detergent storage capacity may be improved by making the first seat portion and the second seat portion to be adjacent to each other on the front partition wall on which the fastening protrusion is not formed.

In one implementation, a maximally protruding point of the fastening elastic portion may be located between the first cover and the second cover while the storage is fully retracted into the cabinet. The detergent storage capacity may be increased by making the fixing assembly and the storage as close to each other in a vertical direction as possible.

In one implementation, the fixing assembly may further include a stopper spaced apart from the fastening elastic portion and protruding toward the storage frame, and the storage may further include an extension limiting portion positioned on the frame partition wall and in contact with the stopper to limit an extension distance of the storage during the extension of the storage. It is possible to prevent the stored detergent from leaking as the storage is unintentionally removed.

In one implementation, the extension limiting portion may be located forwardly of the fastening protrusion. Because the storage is mainly retracted and extended only within a limited extension distance, it is possible to prevent the fastening elastic portion from being excessively interfered with during the retraction and extension of the storage, and to prevent a decrease in durability.

In one implementation, the extension limiting portion may be positioned so as not to overlap with the fastening protrusion when viewed from the front. Thus, it is possible to prevent collision and damage of the fastening protrusion and the stopper during the extension of the storage.

In one implementation, the fixing assembly may include a sliding coupling portion, wherein one end of the fastening elastic portion is slidably coupled to the sliding coupling portion, and a sliding limiting portion constructed to limit a sliding distance of said one end.

In one implementation, the sliding limiting portion may be positioned to face said one end of the fastening elastic portion, and come into contact with said one end of the sliding fastening elastic portion to limit the sliding distance of said one end.

Embodiments of the present disclosure may provide the laundry treating apparatus that may effectively improve the convenience of the user by securing the detergent storage capacity of the storage.

In addition, embodiments of the present disclosure may provide the laundry treating apparatus that may effectively improve the usability based on the retraction and the extension of the storage.

In addition, embodiments of the present disclosure may provide the laundry treating apparatus that may provide the convenience to the user in the processes of the retraction and the extension of the storage.

In addition, embodiments of the present disclosure may provide the laundry treating apparatus that may allow the user to easily recognize whether the storage is coupled in the processes of the retraction and the extension of the storage.

DETAILED DESCRIPTION

Figure 1:
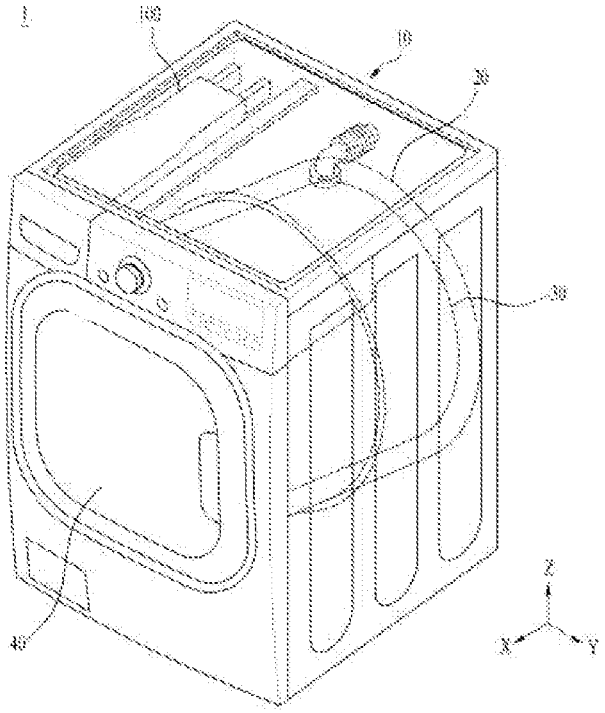
FIG. 1 is a perspective view showing a laundry treating apparatus according to an embodiment of the present disclosure.

Hereinafter, an embodiment of the present disclosure will be described in detail with reference to the accompanying drawings such that a person having ordinary knowledge in the technical field to which the present disclosure belongs may easily implement the embodiment.

However, the present disclosure is able to be implemented in various different forms and is not limited to the embodiment described herein. In addition, in order to clearly describe the present disclosure, components irrelevant to the description are omitted in the drawings. Further, similar reference numerals are assigned to similar components throughout the specification.

Duplicate descriptions of the same components are omitted herein.

In addition, it will be understood that when a component is referred to as being 'connected to' or 'coupled to' another component herein, it may be directly connected to or coupled to the other component, or one or more intervening components may be present. On the other hand, it will be understood that when a component is referred to as being 'directly connected to' or 'directly coupled to' another component herein, there are no other intervening components.

The terminology used in the detailed description is for the purpose of describing the embodiments of the present disclosure only and is not intended to be limiting of the present disclosure.

As used herein, the singular forms 'a' and 'an' are intended to include the plural forms as well, unless the context clearly indicates otherwise.

It should be understood that the terms 'comprises', 'comprising', 'includes', and 'including' when used herein, specify the presence of the features, numbers, steps, operations, components, parts, or combinations thereof described herein, but do not preclude the presence or addition of one or more other features, numbers, steps, operations, components, or combinations thereof.

In addition, in this specification, the term 'and/or' includes a combination of a plurality of listed items or any of the plurality of listed items. In the present specification, 'A or B' may include 'A', 'B', or 'both A and B'.

Figure 2:
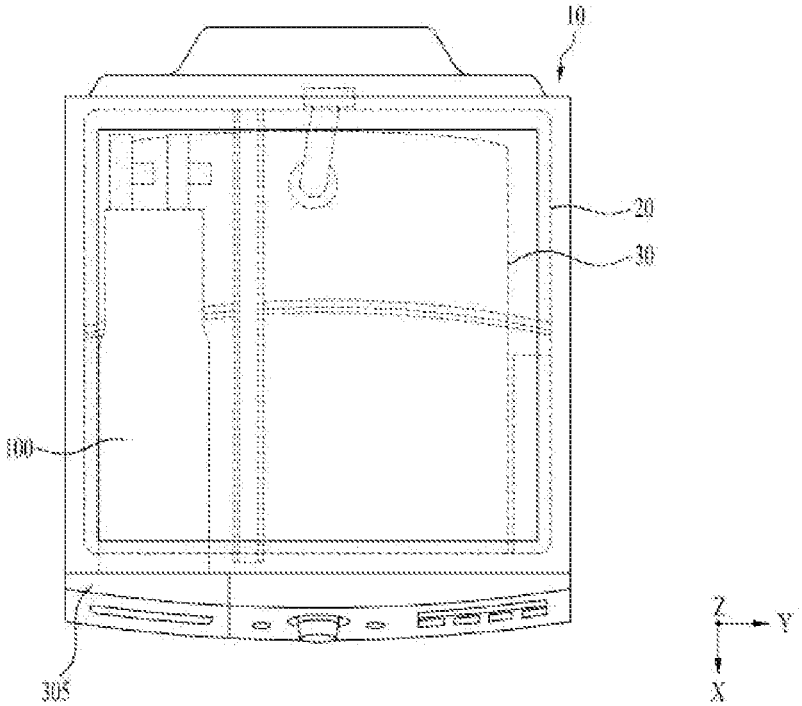
FIG. 2 is a top view of a laundry treating apparatus.
Figure 3:
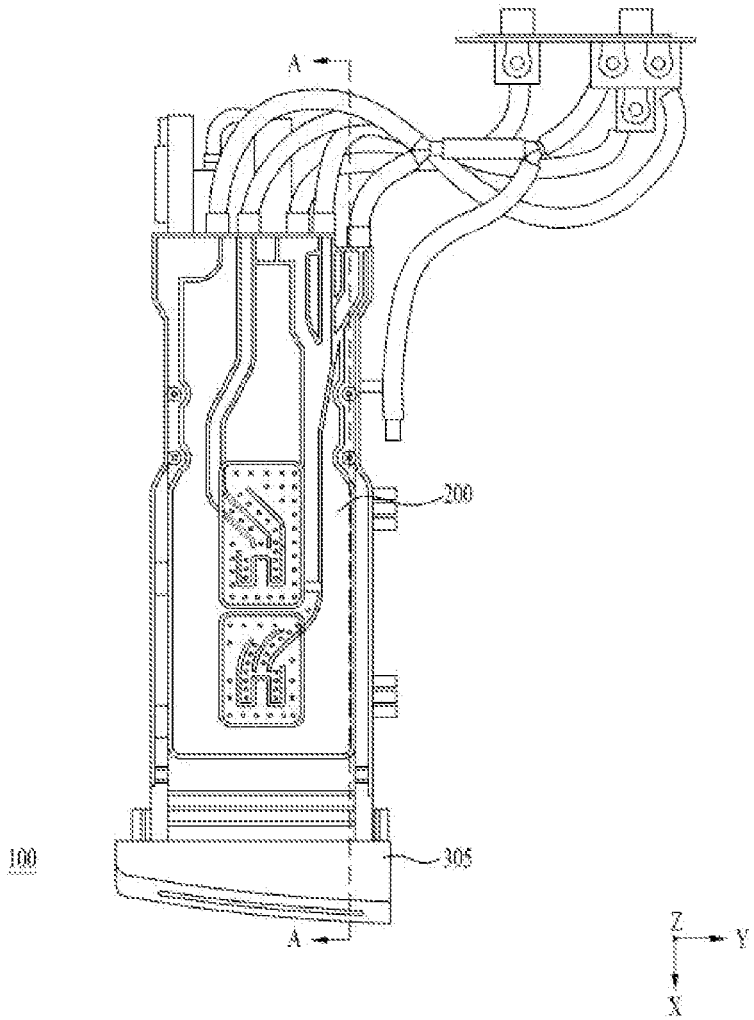
FIG. 3 is a top view showing a detergent feeder of a laundry treating apparatus according to an embodiment of the present disclosure.

FIG. 1 is a perspective view showing a laundry treating apparatus 1 according to an embodiment of the present disclosure, and FIG. 2 is a view of the laundry treating apparatus 1 viewed from above. FIG. 3 is a top view showing a detergent feeder 100 of the laundry treating apparatus 1 according to an embodiment of the present disclosure.

Referring to FIGS. 1 to 3, the laundry treating apparatus 1 according to an embodiment of the present disclosure includes a cabinet 10 having a detergent opening 15 defined in a front surface thereof, a tub 20 installed inside the cabinet 10, a drum 30 rotatably installed inside the tub 20, and the detergent feeder 100 installed inside the detergent opening 15.

The laundry treating apparatus 1 may include a washing machine in which a cloth is inserted into a washing tub to be subjected to washing, rinsing, dehydration, and the like, a dryer in which a wet cloth is inserted to be subjected to drying, or the like.

The laundry treating apparatus 1 may be divided into a top load-type apparatus and a front load-type apparatus. FIG. 1 shows the laundry treating apparatus 1 of the front load-type, which is only for convenience of description, and is also applicable to the top load-type washing machines because the present disclosure does not apply only to the front load-type washing machines.

As shown in FIG. 1, the laundry treating apparatus 1 may include the cabinet 10 that forms an appearance thereof, and a manipulation unit that receives various control commands from a user and has a display (not shown) for displaying information on an operating state. The laundry treating apparatus 1 may include a door 40 pivotably installed on a front surface of the cabinet 10 to allow the laundry to be put into and pulled out of the laundry treating apparatus 1.

The cabinet 10, which forms the appearance of the laundry treating apparatus 1, may have a space defined therein in which various components constituting the laundry treating apparatus 1 may be accommodated. The drum 30 for accommodating therein the laundry input through the door 40 may be installed inside the cabinet 10.

Specifically, inside the cabinet 10, the tub 20 for containing wash water therein, and the drum 30 rotatably disposed in the tub 20 and accommodating the laundry therein may be disposed. A balancer for compensating for eccentricity occurred by rotation may be installed on one side of the drum 30.

The above-described manipulation unit may include various keys for operating the operating state of the laundry treating apparatus 1 and the display for displaying the operating state of the laundry treating apparatus 1. The door 40 may contain a transparent member such as tempered glass such that an interior of the cabinet 10 or the drum 30 may be visually identified.

In one example, in one embodiment of the present disclosure, the laundry treating apparatus 1 may have the detergent opening 15 on the front surface thereof, and a detergent feeder 100 may be positioned at the interior of the cabinet 10 reachable through the detergent opening 15.

A location of the detergent opening 15 may vary. FIG. 1 shows that the detergent opening 15 is defined parallel to the manipulation unit in a lateral direction Y.

The detergent feeder 100 may be installed through the detergent opening 15 that may be defined on one side of an upper portion of the cabinet 10. The detergent feeder 100 may include a storage 300 that may store the detergent therein.

FIG. 3 is a top view of the detergent feeder 100. A fixing assembly disposed inside the cabinet 10, and disposed to face one surface extending in the front and rear direction X of the storage 300 retracted into the detergent opening 15 may be included. The fixing assembly may serve as a guide for guiding a movement of the storage 300 while the storage 300 is retracted into or extended out of the cabinet 10.

The dispenser assembly 200 may serve as the fixing assembly. In this case, the fixing assembly may be understood to mean the dispenser assembly 200.

The detergent feeder 100 serves to automatically supply the detergent stored in the storage 300 into the drum 30 in a washing operation. The detergent means a substance that may enhance a washing effect of the laundry, and may include liquid fiber detergent and liquid fabric softener.

Figure 4:
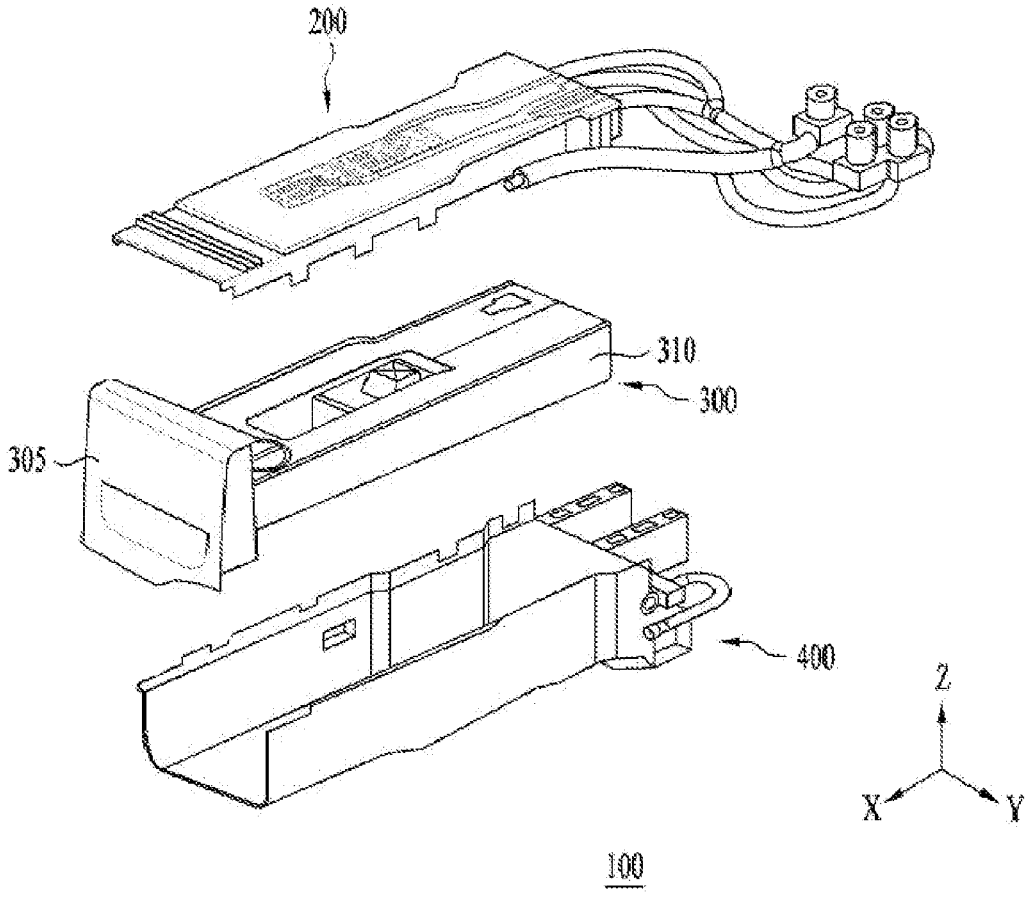
FIG. 4 is an exploded view of a detergent feeder in an embodiment of the present disclosure.

FIG. 4 shows the detergent feeder 100 being disassembled. The detergent feeder 100 may include the dispenser assembly 200, the storage 300, and a supply casing 400 from above as shown in FIG. 4.

The storage 300 is where the detergent is stored, is able to be retracted into the detergent opening 15 along the front and rear direction X, and is able to include a front handle 305 and a storage frame 310 for storing the detergent therein.

In the present disclosure, definition of forward and rearward directions may be achieved based on the detergent opening 15. For example, a direction from the detergent opening 15 to an exterior of the cabinet 10 may be understood as the forward direction, and a direction from the detergent opening 15 to the interior of the cabinet 10 may be understood as the rearward direction. That is, even when the door 40 and the detergent opening 15 are disposed on and defined in different surfaces in the cabinet 10, the forward and rearward directions may be defined based on the detergent opening 15.

Figure 5:
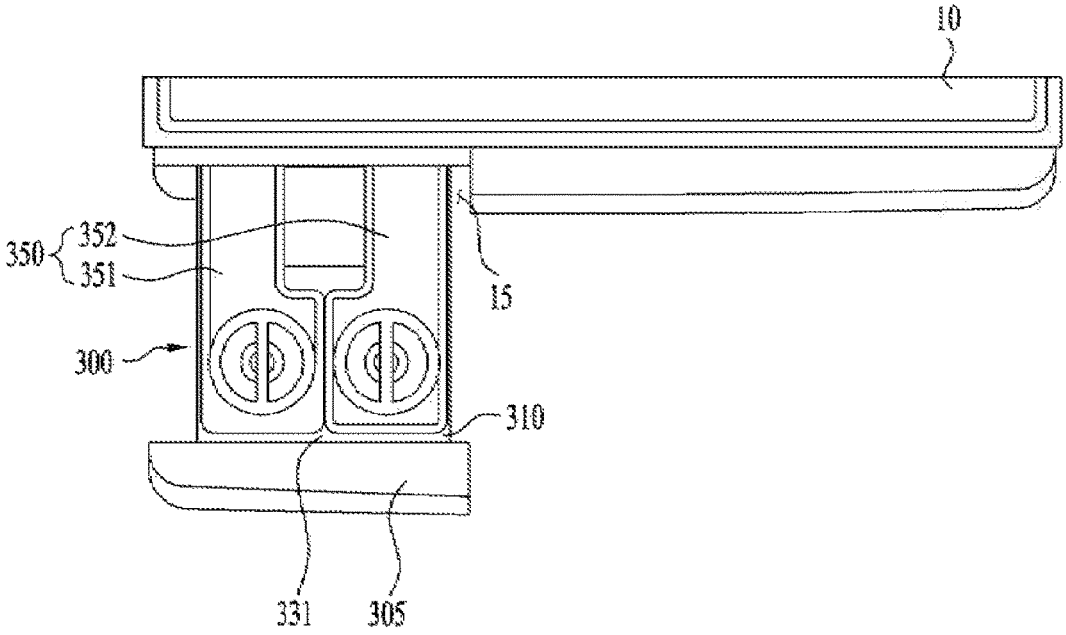
FIG. 5 is a view showing a state in which a storage is extended from a laundry treating apparatus in an embodiment of the present disclosure.

In one example, FIG. 5 shows the storage 300 extended from the detergent opening 15, viewed from the exterior of the cabinet 10.

When the user grips and pulls the handle 305 disposed on the front surface of the storage 300, the storage 300 in the state of being retracted into the detergent opening 15 slides forward from a state of being stacked with the dispenser assembly 200 and the supply casing 400 to be extended to be exposed to the outside of the cabinet 10 or to the outside of the detergent opening 15. Similarly, when the user pushes the handle 305 rearward, the storage 300 may be inserted into the detergent opening 15 while being slid.

Figure 6:
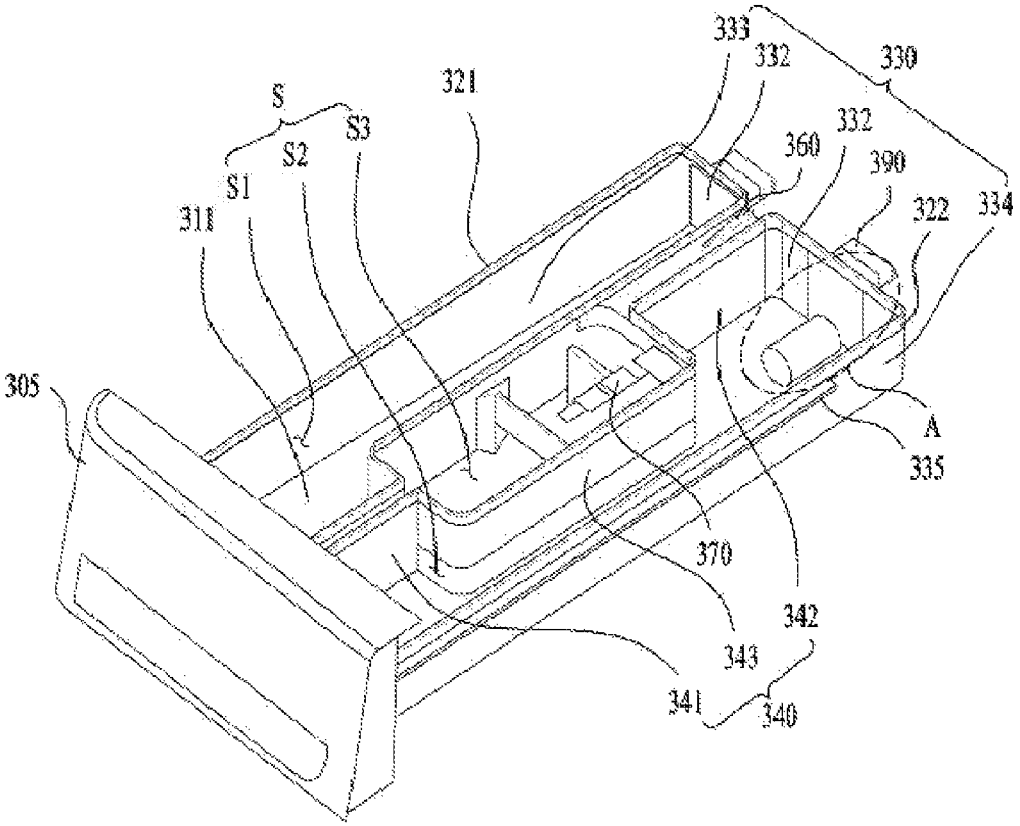
FIG. 6 is a perspective view of a storage according to an embodiment of the present disclosure.
Figure 7:
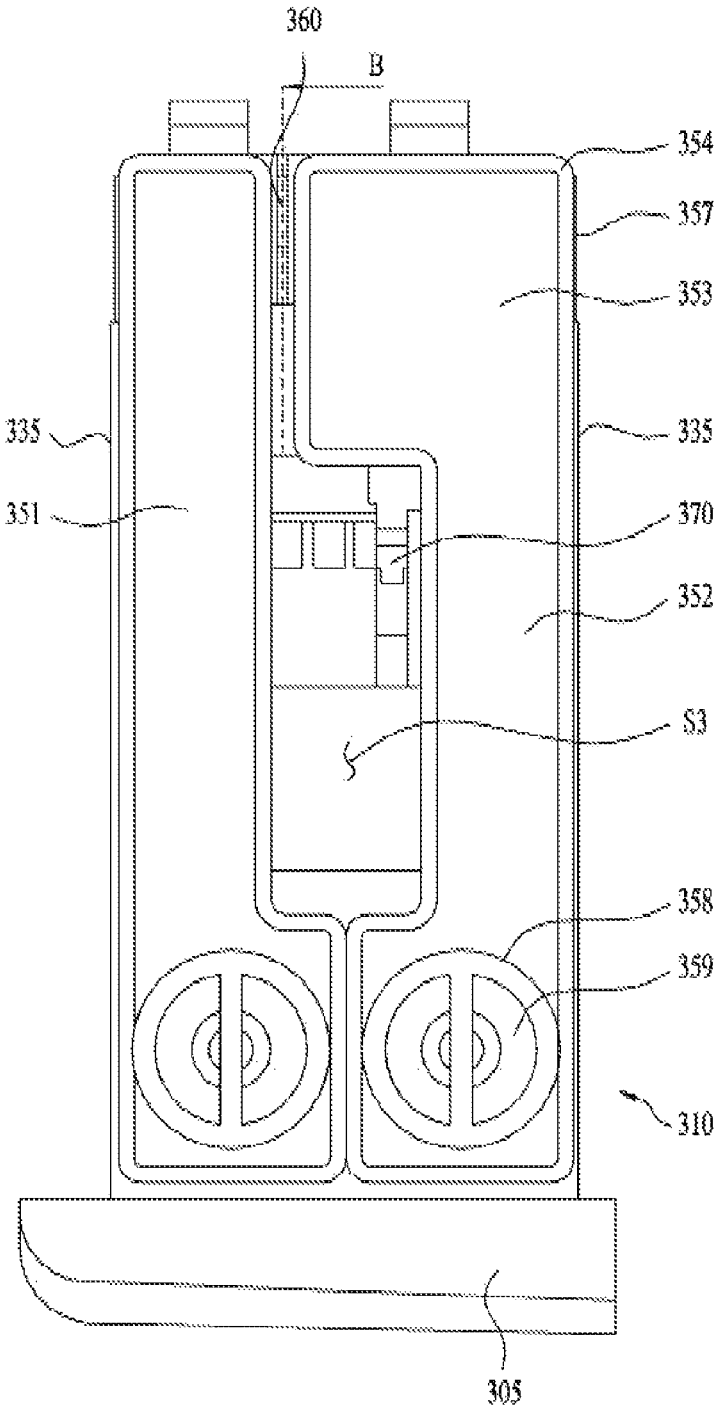
FIG. 7 is a top view of a storage according to an embodiment of the present disclosure.

FIGS. 6 and 7 show a storage of a laundry treating apparatus according to an embodiment of the present disclosure. FIG. 6 shows a storage in a state in which a cover is removed therefrom. FIG. 7 shows a storage in a state in which a cover is coupled thereto.

The laundry treating apparatus 1 according to an embodiment of the present disclosure may include the cabinet 10 having the detergent opening 15 defined in the front surface thereof, the tub 20 disposed inside the cabinet 10, and storing the wash water therein, the drum 30 rotatably disposed inside the tub 20, and storing the laundry therein, and the storage 300 that stores the detergent supplied to the tub 20 therein, and is retracted into or extended from the cabinet 10 through the detergent opening 15. The storage 300 may have the storage frame 310 that has a detergent storage space S in which the detergent is stored defined therein, and has an open top surface such that the detergent storage space S is opened, a cover seat portion 320 disposed on the storage frame 310, and disposed on a perimeter of the detergent storage space S, and a cover 350 that is detachably coupled to the cover seat portion 320 to shield at least a portion of the open top surface of the detergent storage space S.

The detergent opening 15 may be defined to communicate the interior and the exterior of the cabinet with each other. In the present specification, the detergent opening 15 is described as meaning a portion penetrating one side of the cabinet 10. However, the detergent opening 15 may mean an entire space occupied by the storage 300 when the storage 300 is extended.

The storage 300 may be retracted into the cabinet 10 or may be extended from the cabinet 10 through the detergent opening 15. When the storage 300 is extended out of the cabinet 10, it is possible to prevent the storage 300 from being extended by a distance greater than a preset distance using an extension limiting portion 370. The storage 300 may be completely removed from the cabinet 10 by manipulating the extension limiting portion 370.

The handle 305 may be disposed at the front surface of the storage 300 so as to be gripped by the user when extending the storage 300 out of the cabinet 10. The handle 305 may have a handle groove that is recessed so as to be gripped by a finger. The user may extend the storage 300 to the outside of the cabinet 10 by supporting his or her finger in the handle groove.

The user may easily extend the storage 300 using the handle 305 and put the detergent into the extended storage 300. In addition, the user may easily clean or repair the storage 300 by removing the storage 300 from the cabinet 10.

The storage 300 includes the storage frame 310 that stores the detergent needed for the laundry washing therein. The detergent storage space S may be defined by the storage frame 310, and the detergent may be stored inside the detergent storage space S. A separate storage container may not be seated in the detergent storage space S, and the detergent may be in direct contact with the detergent storage space S. That is, the detergent may be stored while being in direct contact with one surface of the storage frame 310.

The detergent stored in the storage frame 310 may be supplied to the tub 20 through a detergent valve 380 that is coupled through one side of the storage frame 310. A pump may be coupled to the detergent valve 380 to discharge the detergent as much as a preset capacity. An amount of detergent discharged may be set to change based on various conditions such as a weight of the laundry being stored, an amount of wash water, the washing course, and the like. Pumps of various uses and types may be applied to the pump.

The detergent stored in the detergent storage space S may be supplied to tub 20 by a certain amount in a plurality of laundry washing processes. However, the present disclosure may not be limited thereto, and all of the detergent stored in the detergent storage space S may be supplied toward the tub 20 in one laundry washing process. This may also be changed based on the various conditions as described above.

The detergent storage space S defined by the storage frame 310 may have the open top surface. The cover 350 may be detachably coupled to shield the open top surface of the detergent storage space S. The cover 350 may be coupled to an upper end of the storage frame 310.

The storage frame 310 has the cover seat portion 320 along the perimeter of the detergent storage space S. The formation of the cover seat portion 320 along the perimeter of the detergent storage space S includes extension along a perimeter of the upper end of the storage frame 310. The cover seat portion 320 may be constructed to protrude upward, but may not be limited thereto, and may be manufactured in various shapes to which the cover 350 may be coupled.

The storage frame 310 may be integrally formed without including the separate detergent storage container as described above, so that the different detergents may be stored separately.

The storage frame 310 may include a frame bottom surface 311 that forms a bottom surface, a frame outer wall 330 that extends upward from edges of the frame bottom surface to define the detergent storage space S, and a frame partition wall 340 that extends upward from the frame bottom surface 311 to divide the detergent storage space.

That is, the detergent storage space S may be defined by the frame outer wall 330 and the frame partition wall 340 extending upward from the frame bottom surface 311, and the detergent storage space S may be divided to store the different detergents. The frame partition wall 340 may connect outer walls of the frame outer wall 330 while crossing the detergent storage space S.

In addition, the frame bottom surface 311 may be formed to trap all of the detergent stored thereon without having a through-hole defined therein. However, the through-hole may be defined on one side of the frame bottom surface 311. The frame partition wall 340 may be formed to surround a perimeter of the through-hole. The detergent may not be stored in the portion in which the through-hole is defined, and may be stored in the tub 20 immediately after being input.

The cover seat portion 320 may be disposed on top of the frame outer wall 330 and the frame partition wall 340. The cover seat portion 320 may extend upward while being disposed on top of the frame outer wall 330 and the frame partition wall 340, and may extend along the perimeter of the detergent storage space S. Accordingly, the cover 350 may be detachably coupled to the cover seat portion 320 to shield an open top surface of at least a portion of the detergent storage space S.

The frame outer wall 330 may include a front outer wall 331 positioned on a front surface of the storage frame. The front outer wall 331 may be formed as a component separate from the handle 305 formed on the front surface of the storage 300 and coupled to the handle 305. However, the present disclosure may not be limited thereto, and the handle 305 may form a front surface of the frame outer wall 330. That is, the handle 305 and the front outer wall 331 may be integrally formed.

The frame outer wall 330 may include a rear outer wall 332 positioned at a rear surface of the storage frame. The rear outer wall 332 may face away from and may be formed parallel to the front outer wall 331. The rear outer wall 332 may extend upward from the frame bottom surface 311.

The frame outer wall 330 may include a first side outer wall 333 and a second side outer wall 334 connecting the front outer wall 331 and the rear outer wall 332 to each other. The first side outer wall 333 and the second side outer wall 334 may extend upward from the frame bottom surface 311 in parallel with each other.

The front outer wall 331, the rear outer wall 332, the first side outer wall 333, and the second side outer wall 334 may be integrally formed with the frame bottom surface 311 to define the detergent storage space S having the open top surface. That is, the detergent storage space S may be defined by the frame bottom surface 311 and the frame outer wall 330.

The frame partition wall 340 may include an auxiliary storage partition wall 343 spaced apart from the frame outer wall 330, and surrounding a portion of the detergent storage space. The space surrounded by the secondary storage partition wall 343 may be defined as a third storage space S3. The through-hole may be defined in a portion of the frame bottom surface 311 forming a bottom surface of the third storage space as described above.

The frame partition wall 340 may include a front partition wall 341 that connects the front outer wall 331 and the auxiliary storage partition wall 343 with each other, and a rear partition wall 342 that connects the rear outer wall 332 and the auxiliary storage partition wall 343 with each other. The front partition wall 341, the auxiliary storage partition wall 343, and the rear partition wall 342 are extended in the front and rear direction to divide the detergent storage space S.

The detergent storage space S may be divided into three spaces by the front partition wall 341, the auxiliary storage partition wall 343, and the rear partition wall 342. The detergent storage space S may be divided into a first storage space S1 defined between the first side outer wall 333 and the frame partition wall 340, a second storage space S2 defined between the second side outer wall 334 and the frame partition wall 340, and the third storage space S3 surrounded by the auxiliary storage partition wall 343.

Detergents stored in the first storage space S1 and the second storage space S2 may not be supplied to the tub 20 immediately after being input, but may remain in the first storage space S1 and the second storage space S2 and then be supplied to the tub 20 by the preset capacity in the plurality of laundry washing processes through the detergent valve 380 penetrating the rear outer wall 332.

The different detergents may be stored in the first storage space S1 and the second storage space S2. A liquid detergent may be stored in the first storage space S1 and the second storage space S2. The liquid detergent may include a laundry detergent or a fabric softener used in a general laundry process. The detergents stored in the first storage space S1 and the second storage space S2 may be introduced into the tub 20 through the detergent valve 380 as needed, so that the detergents may preferably be liquid detergents.

As an example of the use of the present disclosure, the laundry detergent may be stored in the first storage space S1 and the fabric softener may be stored in the second storage space S2, and the laundry detergent may be supplied to the tub 20 from the first storage space S1 in a washing process and the fabric softener may be supplied from the second storage space S2 to the tub 20 in a final rinsing process.

Because the detergents necessary for the washing and rinsing processes may be stored in the first storage space S1 and the second storage space S2, the hassle of having to put the detergent every time the user uses the laundry treating apparatus 1 may be eliminated. That is, there is an effect of increasing convenience of the user in using the laundry treating apparatus 1.

In addition, because the detergent storage container disposed separately from the storage frame 310 may not be used, there is an effect of storing more detergent in the space used to be occupied by the detergent storage container. That is, a detergent injection cycle of the user becomes longer, so that the convenience of the user may be increased.

In one example, the cover 350 may include a first cover 351 and a second cover 352 that shield open top surfaces of the first storage space S1 and the second storage space S2, respectively. When the first storage space S1 or the second storage space S2 is used while the top surface thereof is opened, the stored detergent may leak to the outside by vibration of the laundry treating apparatus 1 or during the process of retraction and extension of the storage 300.

The first cover 351 and the second cover 352 may shield the open top surfaces of the first storage space S1 and the second storage space S2 to define the closed first storage space S1 and second storage space S2, respectively. Therefore, it is possible to prevent the detergent from leaking to the outside in an operation process of the laundry treating apparatus 1 or in the process of injecting the detergent into the first storage space S1 or the second storage space S2 and retracting and extending the storage 300 into and out of the cabinet 10.

The first cover 351 and the second cover 352 may prevent the storage 300 and the laundry treating apparatus 1 from being contaminated by the detergent leaking to the outside as described above, and may save the user's trouble of cleaning the contaminated portion. That is, there is an effect of increasing usability and convenience of the user.

The auxiliary storage partition wall 343 may define the third storage space S3 to be separated from the first storage space S1 and the second storage space S2. A top surface of the third storage space S3 may not be shielded by the cover 350. That is, the top surface of the third storage space S3 may always be opened.

In the third storage space S3, a detergent different from those in the first storage space S1 and the second storage space S2 may be stored. The through-hole may be defined in the frame bottom surface 311 forming the bottom surface of the third storage space S3. The detergent stored in the third storage space S3 may be supplied to the tub 20 through the through-hole, unlike those in the first storage space S1 and the second storage space S2.

In the third storage space S3, detergent in a form that is not frequently used may be input. For example, when it is necessary to use detergent, which is less frequently used than the general laundry detergent or the fabric softener, such as bleach, neutral detergent, or the like, the user may directly extend the storage 300 out of the cabinet 10 and put the detergent by a required capacity into the third storage space S3. However, the present disclosure may not be limited thereto. The detergent input to the third storage space S3 may be the same as the detergent stored in the first storage space S1 or the second storage space S2, and may correspond to the detergent in the powder form. That is, not only the liquid detergent, but also various types of detergent may be put into the third storage space S3 and used in the washing process.

A water supply valve may be disposed above the third storage space S3 such that the detergent injected into the third storage space S3 may receive water from above. The water supply may be performed by the dispenser assembly 200. The detergent accommodated in the third storage space S3 together with the wash water discharged from the water supply valve may be discharged toward the tub 20.

As described above, as the third storage space S3 is defined, the various detergents, separately from the detergent stored in the first storage space S1 or the second storage space S2, may be used for the laundry washing based on needs of the user, so that the convenience of the user is increased. In addition, because the top surface of the third storage space S3 is opened, the user may easily inject the detergent without the process of removing the cover independently.

The cover seat portion 320 may include a first seat portion 321 to which the first cover is coupled and a second seat portion 322 to which the second cover is coupled. The first cover 351 and the second cover 352 may be separated from each other to individually shield the open top surfaces of the first storage space S1 and the second storage space S2, respectively.

The first seat portion 321 may extend along a perimeter of the first storage space S1. The extension along the perimeter of the first storage space S1 may mean extension along perimeters of upper ends of the first side outer wall 333, the front outer wall 331, the rear outer wall 332, and the frame partition wall 340 defining the first storage space S1.

The first seat portion 321 may protrude upward from a portion of the storage frame 310. A closed cross-section may be formed when the first seat portion 321 is viewed from the top. The formation of the closed cross-section may mean that a starting point and an end point of the extension of the first seat portion 321 along the perimeter of the first storage space S1 are the same.

For example, when the first seat portion 321 extends starting from a connection point between the first side outer wall 333 and the front outer wall 331, the first seat portion may extend along the front outer wall 331 from the starting point, then extend along the frame partition wall 340 from a connection point of the front outer wall 331 and the frame partition wall 340, then extend again along the rear outer wall 332 from a connection portion between the frame partition wall 340 and the rear outer wall 332, and then finally extend along the first side outer wall 333 to return to the starting point.

The first cover may be coupled to the first seat portion 321 extended as described above, so that the open top surface of the first storage space S1 may be shielded. That is, the detergent stored in the first storage space S1 may be safely stored.

With the same scheme as described above for the first seat portion 321, a second seat portion 322 extending along the perimeter of the second storage space and to which the second cover 352 is coupled may be formed. The second seat portion may extend along the second side outer wall 334, the rear outer wall 332, the frame partition wall 340, and the front outer wall 331 to form a closed cross-section in the same manner as the first seat portion 321.

The first cover 351 and the second cover 352 should be respectively formed on the front partition wall 341 and the rear partition wall 342 so as to be coupled to the first seat portion 321 and the second seat portion 322 to shield the first storage space S1 and the second storage space S2, respectively. In order for the first cover 351 and the second cover 352 to be respectively coupled to the first seat portion 321 and the second seat portion 322, the first seat portion 321 and the second seat portion 322 should be spaced apart from each other. Accordingly, the first seat portion and the second seat portion may be respectively formed on the front partition wall 341 and the rear partition wall 342.

As an embodiment, the cover seat portion 320 having two portions protruding to be spaced apart from each other in a width direction of the storage 300 may be disposed on the front partition wall 341, and one of the portions may constitute the first seat portion 321 and the other may constitute the second seat portion 322. When the portion constituting the first seat portion 321 is present on a left side when the storage 300 is viewed from the front, the first seat portion 321 may extend to the rear partition wall 342 along a portion on a left side of the point connected to the auxiliary storage partition wall 343.

As described above for the first seat portion 321 and the second seat portion 322 formed on the front partition wall 341, the first seat portion 321 and the second seat portion 322 may be formed on the rear partition wall 342 in the same scheme.

Figure 8:
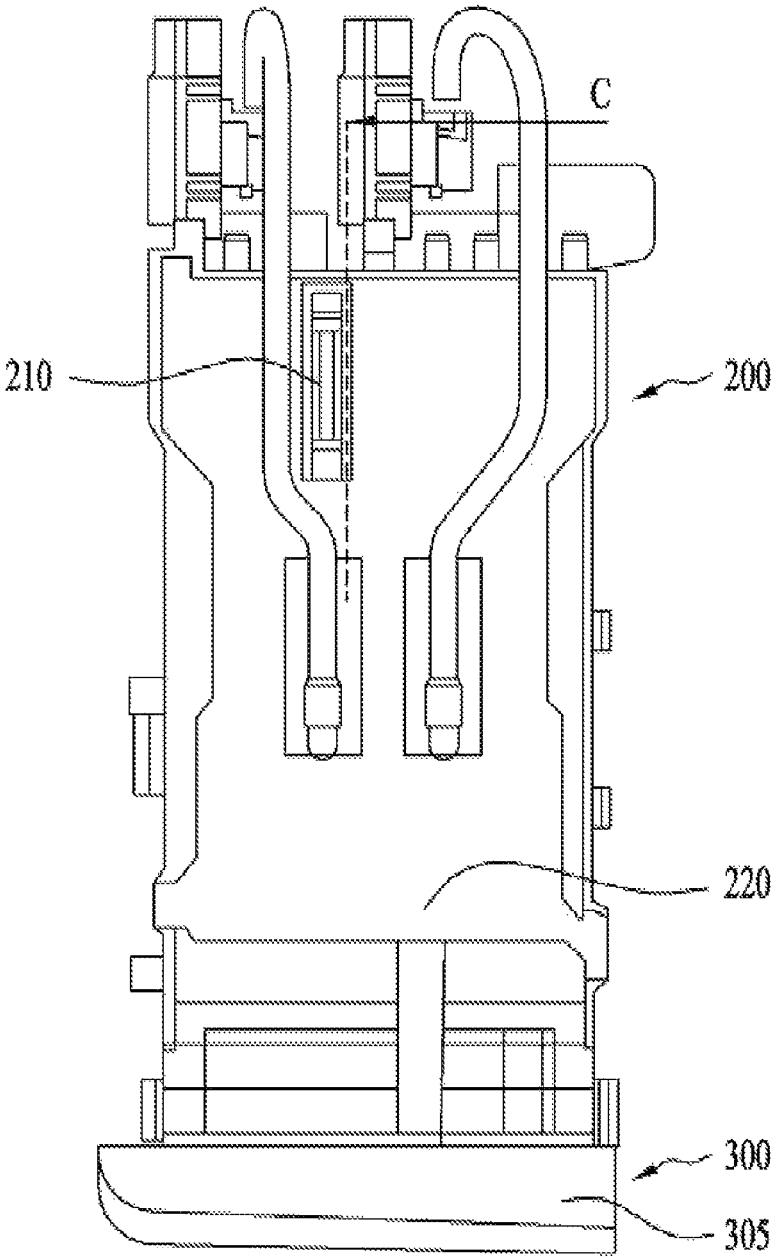
FIG. 8 is a top view of a fixing assembly according to an embodiment of the present disclosure.

FIG. 8 shows a fixing assembly according to an embodiment of the present disclosure. In the present specification, the dispenser assembly may be understood to be the same component as the fixing assembly.

Referring to FIGS. 6 to 8, an embodiment of the present disclosure includes the cabinet (see FIG. 1) that has the detergent opening (see FIG. 5) defined in the front surface thereof, the tub (see FIG. 1) that is disposed inside the cabinet and stores the wash water therein, the drum (see FIG. 1) that is rotatably disposed inside the tub and stores the laundry therein, the storage 300 that includes the storage frame 310 in which the detergent storage space for storing the detergent supplied to the tub therein is defined, and is retracted into or extended from the cabinet through the detergent opening, and the fixing assembly that is disposed inside the cabinet to face the storage 300 and includes the fastening elastic portion 210 protruding toward the storage 300. The storage frame 310 includes the frame outer wall 330 that forms the outer wall of the storage frame 310 and surrounds the detergent storage space S, and the frame partition wall 340 that is disposed in the storage frame 310, partitions the detergent storage space S, and includes a fastening protrusion 360 protruding toward the fixing assembly. The fastening elastic portion 210 is pressed and elastically deformed by the fastening protrusion 360 in the process of retraction and extension of the storage 300. For example, the fastening elastic portion 210 may include a protrusion or a strip of an elastic material such as plastic, rubber, metal, etc.

As the fastening protrusion 360 is not disposed on the frame outer wall 330, but on the frame partition wall 340, a space used for the fastening protrusion 360 may be saved. Accordingly, there is an effect of expanding a space in which the detergent may be stored, and there is an effect of increasing the user convenience as a detergent replenishment cycle of the user may be increased by storing more detergent in the storage 300.

The frame outer wall 330 may include the front outer wall 331 positioned on the front surface of the storage frame 310, and the rear outer wall 332 positioned on the rear surface of the storage frame 310, and the frame partition wall 340 may connect the front outer wall 331 and the rear outer wall 332 to each other.

When the frame partition wall 340 connects the front outer wall 331 and the rear outer wall 332 to each other, the detergent storage space S may be divided into a plurality of spaces along the frame partition wall 340 extending in the front and rear direction, and the detergent may be stored in each space.

In addition, when the frame partition wall 340 extends in the front and rear direction, the fastening protrusion 360 disposed on the frame partition wall 340 may be in contact with the fastening elastic portion 210 with a large area. Accordingly, an elastic resistance of the fastening elastic portion 210 may increase, and the user may easily sense whether the storage 300 is coupled, thereby improving the usability of the laundry treating apparatus.

The frame partition wall 340 may include the auxiliary storage partition wall 343 that is spaced apart from the frame outer wall 330 and surrounds the portion of the detergent storage space S, the front partition wall 341 that connects the front outer wall 331 and the auxiliary storage partition wall 343 to each other, and the rear partition wall 342 that connects the rear outer wall 332 and the auxiliary storage partition wall 343 to each other. The fastening protrusion 360 may be disposed on the rear partition wall 342.

When the fastening protrusion 360 is disposed on the rear partition wall 342, the fastening elastic portion 210 that comes into contact with the fastening protrusion 360 and presses the fastening protrusion 360 may also be disposed at a rear portion of the fixing assembly. In the process in which the storage 300 is retracted in and extended, the fastening elastic portion 210 may be interfered with by the storage 300. However, when the fastening elastic portion 210 is disposed at the rear portion of the fixing assembly, it is possible to reduce a frequency of interference. Accordingly, there is an effect of improving the durability of the fastening elastic portion 210.

Figure 9:
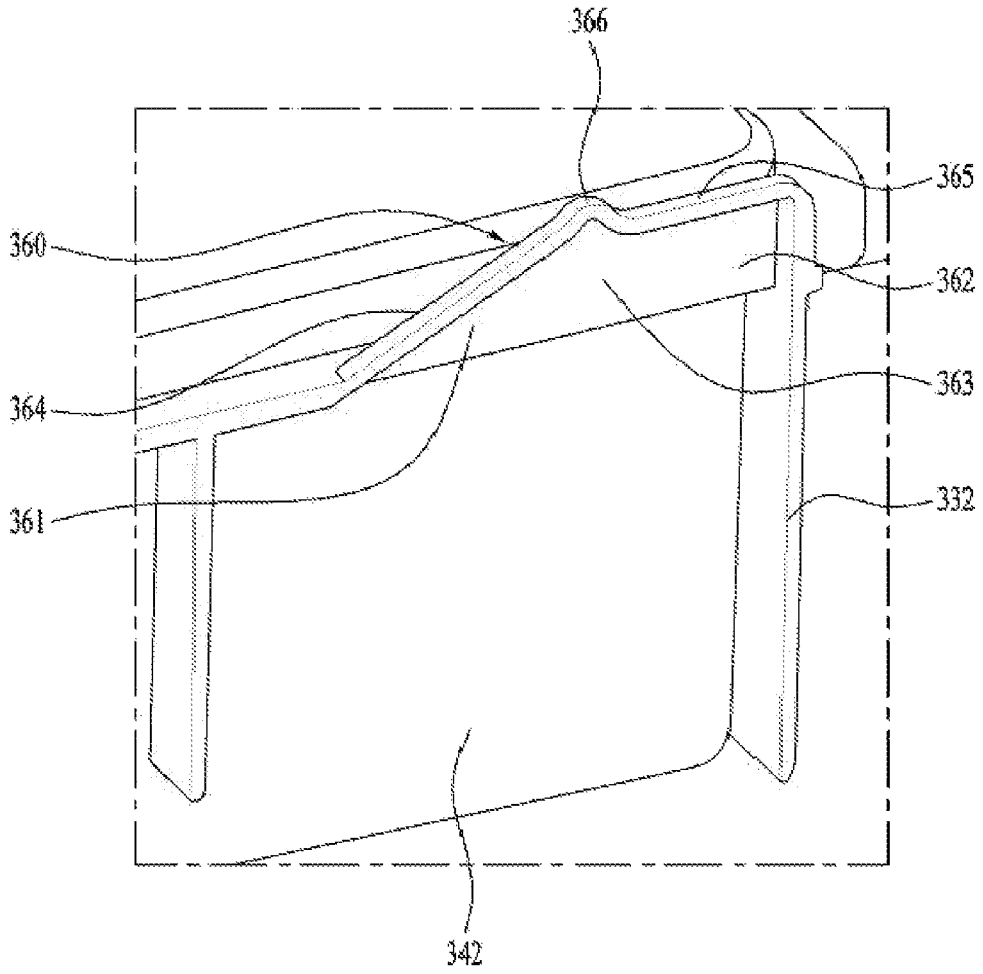
FIG. 9 is a cross-sectional perspective view of a fastening protrusion according to an embodiment of the present disclosure.
Figure 10:
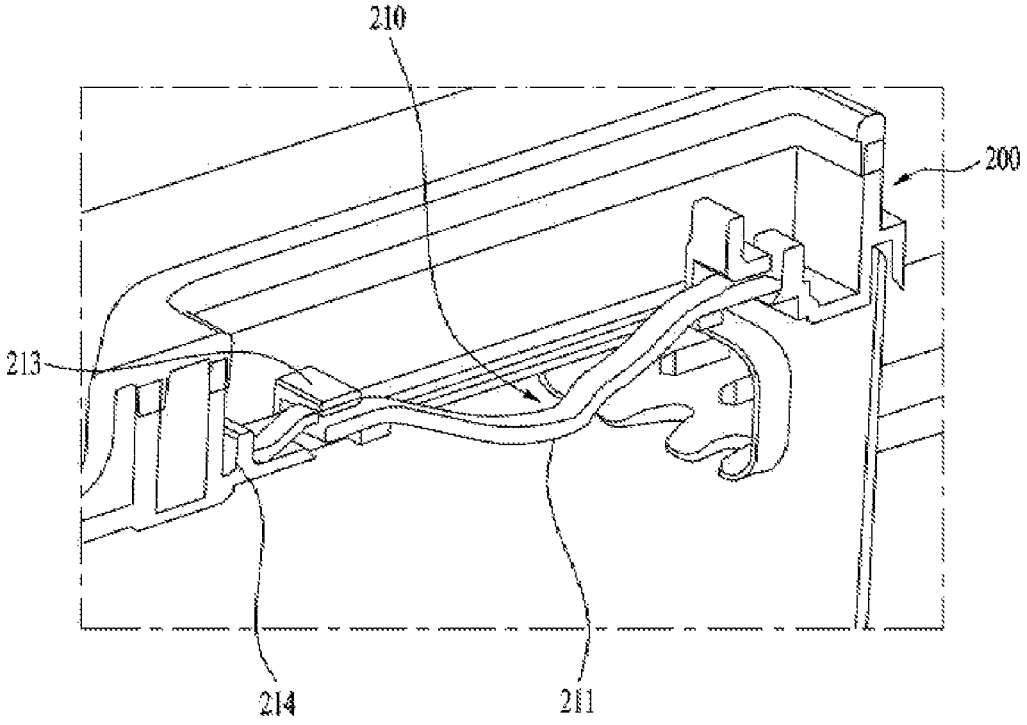
FIG. 10 is a perspective view of a fastening elastic portion according to an embodiment of the present disclosure.
Figure 11:
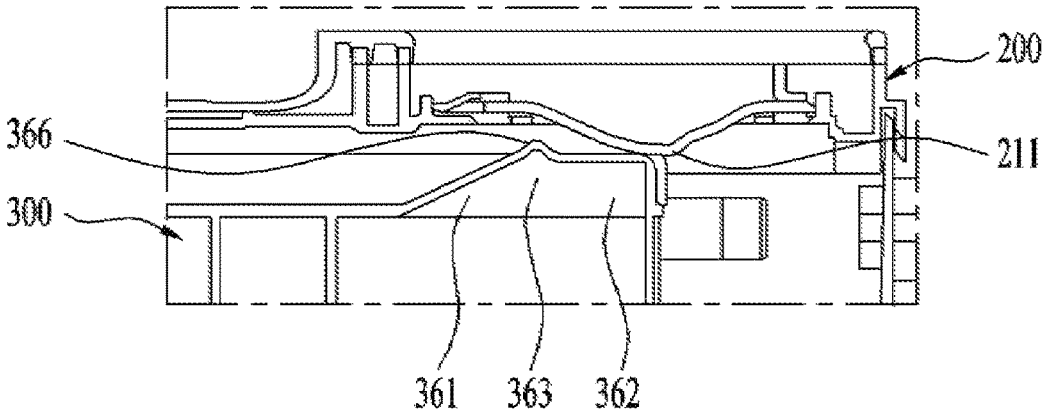
FIG. 11 shows a fastening protrusion and a fastening elastic portion before a storage is retracted, according to an embodiment of the present disclosure.
Figure 12:
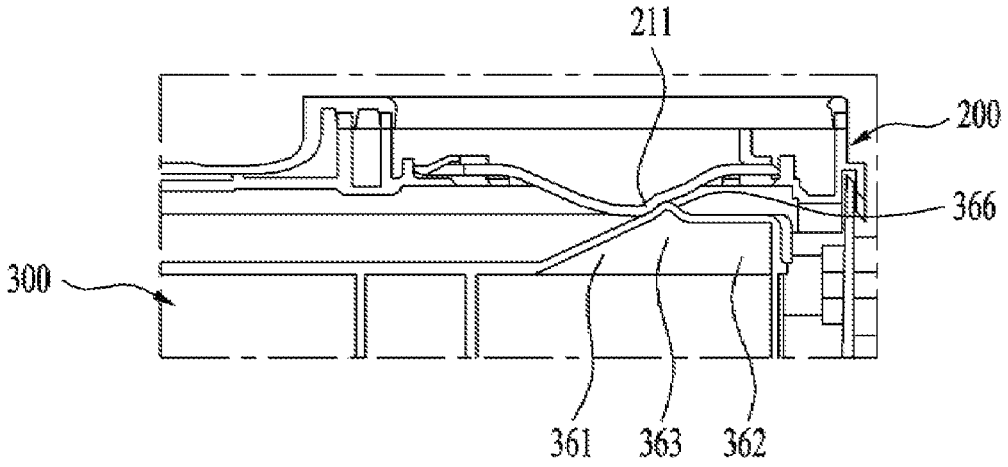
FIG. 12 shows a fastening protrusion and a fastening elastic portion while a storage is fully retracted, according to an embodiment of the present disclosure.

FIG. 9 is an enlarged view of the fastening protrusion according to an embodiment of the present disclosure, and shows a cross-section of the fastening protrusion taken along a line B in FIG. 7. FIG. 10 is an enlarged view of the fastening elastic portion according to an embodiment of the present disclosure, and shows a cross-section of the fastening protrusion taken along a line C in FIG. 8. FIGS. 11 and 12 show a positional relationship between the fastening protrusion and the fastening elastic portion in the retraction and extension process of the storage.

Referring to FIGS. 9 to 12, a rear end of the fastening protrusion 360 may be constructed to be connected to the rear outer wall 332. The rear end of the fastening protrusion 360 may extend downward to form one surface with a rear portion of the rear outer wall 332.

The fastening protrusion 360 may be continuously pressurized and impacted by the fastening elastic portion 210 in the retraction and extension process of the storage 300, so that the durability of the fastening protrusion 360 should be secured.

When the fastening protrusion 360 is not connected to the rear outer wall 332 and is formed to protrude only on the rear partition wall 342, there is a risk that the fastening protrusion 360 is damaged by the external continuous impact because of not being sufficiently supported. On the other hand, when the fastening protrusion 360 is manufactured in the form connected to the rear outer wall 332, the durability thereof may be improved. In addition, when the fastening protrusion 360 and the rear outer wall 332 form one surface, because a mold may be designed simply, the manufacturing may become easy.

Referring to FIG. 9, the fastening protrusion 360 may include a front contact portion 361 that is disposed at a front portion of the fastening protrusion 360 and has a rear end protruding to be higher than a front end to form an inclined surface 364, a rear contact portion 362 that is disposed at a rear portion of the fastening protrusion 360 and protrudes so as to be in contact with the fastening elastic portion 210, and a maximally protruding portion 363 that connects the front contact portion 361 and the rear contact portion 362 to each other and includes a maximally protruding point 366 of the fastening protrusion 360 protruding toward the fixing assembly.

The maximally protruding portion 363 allows the user to feel a sense of resistance in the process in which the storage 300 is retracted or extended. While the storage 300 moves in the front and rear direction with respect to the fastening elastic portion 210, the maximally protruding portion 363 may deform the fastening elastic portion 210 to the maximum. At a point at which the fastening elastic portion 210 is deformed to the maximum, the user may feel the sense of resistance maximally through the handle 305. The user may sense the degree of extension or retraction of the storage 300 based on a change in the sense of resistance. Accordingly, a feeling of use of the laundry treating apparatus may be improved.

The front contact portion 361 rearwardly increases in a vertical level protruding toward the fixing assembly from the rear partition wall 342 to form the inclined surface 364. When the inclined surface 364 is formed, it is possible to prevent a sudden impact from being applied to the fastening elastic portion 210 during the extension process of the storage 300. That is, the durability of the fastening elastic portion 210 may be increased.

In addition, the fastening elastic portion 210 may decrease in the elastic force and sag with continuous use. When the inclined surface 364 is formed on the front contact portion 361, even when the fastening elastic portion 210 is deformed, the fastening protrusion 360 may be pressed. Therefore, even when the deformation occurs in the fastening elastic portion 210 with passage of time, coupling with the fastening protrusion 360 is maintained.

The rear contact portion 362 may be formed at a vertical level capable of contacting the fastening elastic portion 210. The rear contact portion 362 may prevent an abrupt impact from being applied to the fastening elastic portion 210 in the retraction process of the storage 300, and may improve the feeling of use by allowing the user to recognize the sense of resistance for the first time.

In the state in which the storage 300 is fully retracted into the cabinet 10, a maximally protruding point 211 of the fastening elastic portion 210 protruding toward the storage 300 may be located forwardly of the maximally protruding portion 363 to support the fastening protrusion 360.

The fastening elastic portion 210 may be deformed by the fastening protrusion 360 and the fastening elastic portion 210 may press the fastening protrusion 360 in the process in which the storage 300 is retracted. Even when the storage 300 is fully retracted, the fastening elastic portion 210 may maintain the deformed state and press the fastening protrusion 360. When the maximally protruding portion 363 is positioned rearwardly of the maximally protruding point 211 of the fastening elastic portion 210, the fastening protrusion 360 may be pressed rearward. As a result, the storage 300 may be securely mounted inside the cabinet 10.

In addition, when applying a force greater than the elastic force of the fastening elastic portion 210 in the state in which the storage 300 is retracted, the storage 300 may be extended. Because of the above structure, the storage 300 may be easily retracted and extended, and the coupling strength may be improved.

In addition, the rear contact portion 362 may include a horizontal extension section 365 in which the height protruding from the rear partition wall 342 is uniform along the longitudinal direction. The horizontal extension section 365 may protrude to a vertical level capable of contacting the fastening elastic portion 210. In the process in which the storage 300 is extended, the user may receive the same sense of resistance in a section in which the fastening elastic portion 210 comes into contact with the horizontal extension section 365. However, a moment a rear end of the horizontal extension section 365 passes the maximally protruding point 211 of the fastening protrusion, the contact between the fastening elastic portion 210 and the fastening protrusion 360 may be released. A moment the contact is released, the sense of resistance felt by the user may disappear, and the user may recognize how much the storage 300 is extended. That is, there is an effect that the feeling of use of the user is improved.

A rear surface of the rear contact portion 362 may extend from a rear surface of the rear outer wall 332. The fastening protrusion 360 may be continuously pressed and impacted by the fastening elastic portion 210 during the retraction and extension process of the storage 300, so that the durability of the fastening protrusion 360 must be ensured.

When the rear contact portion 362 is not connected to the rear outer wall 332, there is the risk that the fastening protrusion 360 is damaged by the external continuous impact because of not being sufficiently supported. On the other hand, when the rear surface of the rear contact portion 362 extends to form one surface with the rear surface of the rear outer wall 332, because the fastening protrusion 360 may be supported on the rear partition wall 342 and the rear outer wall 332 at the same time, the durability of the fastening protrusion 360 may be improved. In addition, when the rear surface of the rear contact portion 362 extends to form one surface with the rear surface of the rear outer wall 332, because the mold may be designed simply, the manufacturing may become easy.

The first seat portion 321 and the second seat portion 322 extend to be spaced apart from each other along the rear partition wall 342, and the fastening protrusion 360 may be formed between the first seat portion 321 and the second seat portion 322 on the rear partition wall 342.

The fastening protrusion 360 may be disposed in the space between the first seat portion 321 and the second seat portion 322 to utilize the space that was not used before, thereby improving an efficiency of space utilization. In addition, the fastening protrusion 360 may be partially supported by the first cover 351 or the second cover 352 coupled to the first seat portion 321 or the second seat portion 322, so that it is possible to alleviate the impact caused by the fastening elastic portion 210. That is, the durability of the fastening protrusion 360 is improved.

The first seat portion 321 and the second seat portion 322 may extend to be spaced apart from each other along the front partition wall 341 and the rear partition wall 342, and may be further spaced apart from each other on the rear partition wall 342 than on the front partition wall 341. On the front partition wall 341 on which the fastening protrusion 360 is not formed, the first seat portion 321 and the second seat portion 322 are closer to each other than on the rear partition wall 342, so that a detergent storage capacity may be increased. As the detergent storage capacity increases, the detergent input cycle of the user increases, so that the convenience of use may be increased.

In addition, in the state in which the storage 300 is fully retracted into the cabinet 10, the maximally protruding point 211 protruding toward the storage 300 of the fastening elastic portion 210 may be located between the first cover 351 and the second cover 352.

When the maximally protruding point 211 of the fastening elastic portion 210 is located between the first cover 351 and the second cover 352, a gap between the fastening protrusion 360 and the storage 300 may be minimized. That is, a gap between the storage 300 and the fixing assembly may be reduced. That is, a height of the storage 300 may be increased, which may lead to the increase in the detergent storage capacity. As the detergent storage capacity increases, the cycle for the user to input the detergent may increase, and the convenience of use of the user may be increased.

Figure 13:
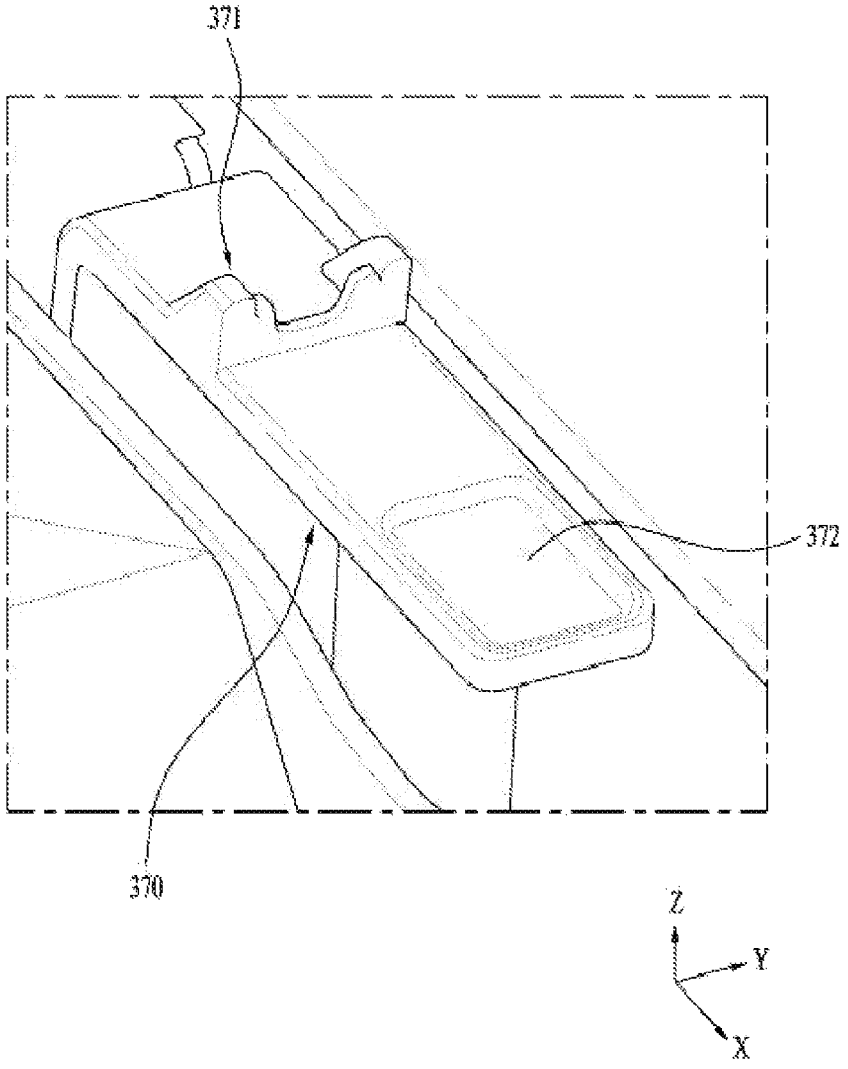
FIG. 13 is a perspective view of an extension limiting portion according to an embodiment of the present disclosure.
Figure 14:
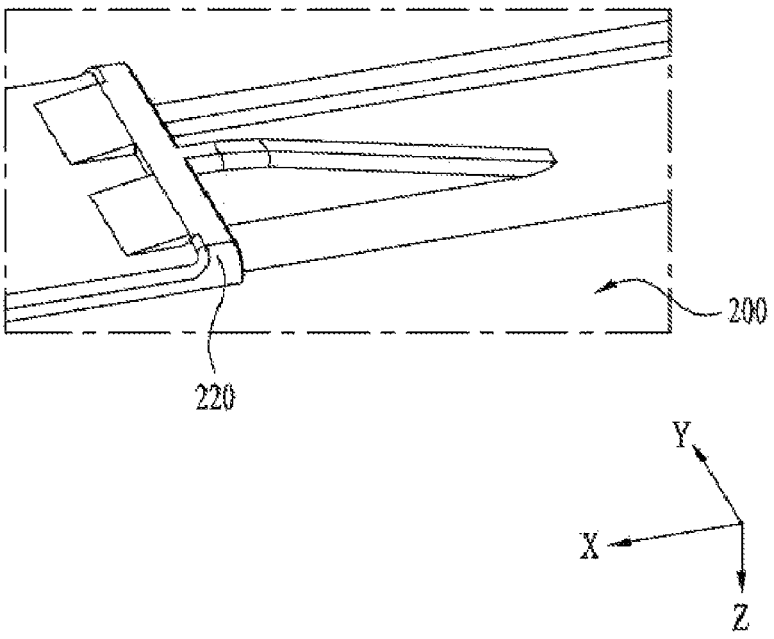
FIG. 14 is a perspective view of a stopper according to an embodiment of the present disclosure.
Figure 15:
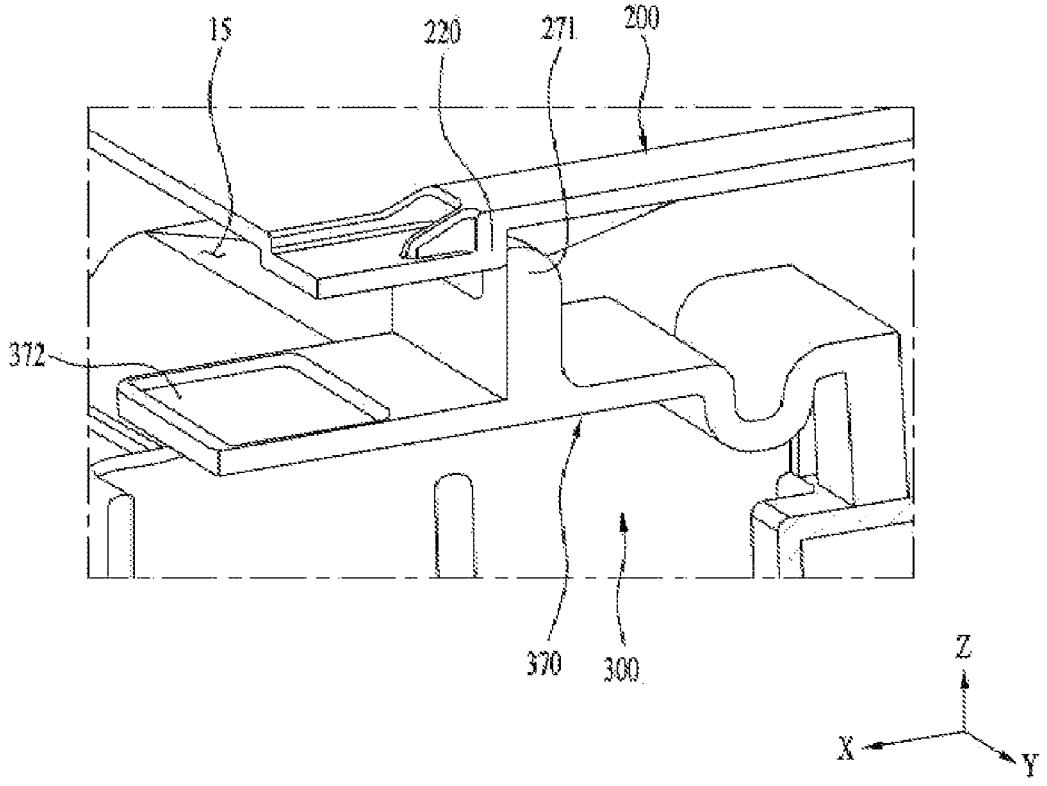
FIG. 15 shows a state in which an extension limiting portion and a stopper are coupled to each other, according to an embodiment of the present disclosure.

FIG. 13 is an enlarged view of an extension limiting portion disposed in a storage frame. FIG. 14 is an enlarged view of a stopper formed on a rear surface of a fixing assembly. FIG. 15 shows a state in which an extension limiting portion is coupled to a stopper in an extension process of a storage.

Referring to FIGS. 13 to 15, in one embodiment of the present disclosure, the fixing assembly may further include a stopper 220 spaced apart from the fastening elastic portion 210 and protruding toward the storage frame 310, and the storage 300 may further include an extension limiting portion 370 located on the frame partition wall 340, and in contact with the stopper 220 during the extension of the storage 300 to limit the extension distance of the storage 300.

In addition, the extension limiting portion 370 may be located forwardly of the fastening protrusion 360. In a general use environment, the storage 300 may be mainly retracted and extended within a distance limited by the extension limiting portion 370. Therefore, when the fastening protrusion 360 is located forwardly of the extension limiting portion 370, there is a possibility that the fastening elastic portion 210 constructed to be in contact with the fastening protrusion 360 is pressed and deformed by the storage 300 even when the storage 300 is retracted and extended within the limited distance.

However, when the fastening protrusion 360 is disposed rearwardly of the extension limiting portion 370, it is possible to reduce the number of times the fastening elastic portion 210 is pressed and deformed by the storage 300. Therefore, when the extension limiting portion 370 is disposed forwardly of the fastening protrusion 360, there is an effect of increasing the durability of the fastening elastic portion 210.

In addition, the extension limiting portion 370 may be positioned so as not to overlap the fastening protrusion 360 when viewed from the front. The stopper 220 may be disposed at a position to face the extension limiting portion 370. Therefore, when the extension limiting portion 370 and the fastening protrusion 360 overlap when viewed from the front, the stopper 220 may interfere with the fastening protrusion 360, thereby impeding a movement of the stopper 220. Therefore, when the extension limiting portion 370 and the fastening protrusion 360 are disposed so as not to overlap, because it is possible to prevent the stopper 220 and the fastening protrusion 360 from interfering, there is an effect of increasing the convenience of use.

An embodiment of the present disclosure may further include the extension limiting portion 370 in the storage 300, and the extension limiting portion 370 may be exposed to the outside of the detergent opening 15 in the state in which the storage 300 is extended by a set extension distance.

The stopper 220 may be disposed in the dispenser assembly 200 and protrude downward toward the storage 300. The stopper 220 may be disposed on the bottom surface of the dispenser assembly 200, and may be disposed so as not to overlap with the fastening elastic portion 210 in the front and rear direction X. That is, the stopper 220 may be disposed to be spaced apart from the fastening elastic portion 210 in the lateral direction Y.

The extension limiting portion 370 may be disposed in the storage 300 and may protrude upward toward the dispenser assembly 200. The extension limiting portion 370 may be disposed so as not to overlap the fastening protrusion 360 in the front and rear direction X. For example, the fastening protrusion 360 may be disposed on the rear partition wall 342 of the storage frame 310, and the extension limiting portion 370 may be disposed on one side of the auxiliary storage partition wall 343 that does not overlap the rear partition wall 342.

The stopper 220 may be disposed in parallel with the extension limiting portion 370 along the front and rear direction X to overlap each other. Accordingly, in the process of extension of the storage 300, the stopper 220 overlaps the extension limiting portion 370, so that the movement of the storage 300 may be restricted.

In addition, in the state in which the storage 300 is retracted into the detergent opening 15, the stopper 220 may be disposed to be spaced forwardly apart from a fastening portion 371, and a spacing distance between the stopper 220 and the fastening portion 371 may correspond to the preset extension distance.

Therefore, in the case in which the user extends the storage 300 by gripping the handle 305 of the storage 300 from the state in which the storage 300 is retracted into the detergent opening 15, when the fastening portion 371 of the extension limiting portion 370 comes into contact with the stopper 220 of the dispenser assembly 200, the extension of the storage 300 may be limited, and the user may store the detergent using the storage 300 extended by the set extension distance.

Specifically, the extension limiting portion 370 may have a rear end fixed to the storage 300 and a front end 372 that forms a free end. Accordingly, the extension limiting portion 370 may be elastically deformed, and the front end 372 thereof may be moved in the vertical direction Z around the rear end, which may be accomplished by the user pressing the front end 372 of the extension limiting portion 370.

The fastening portion 371 may be formed to protrude upward between the front and rear ends of the extension limiting portion 370. Therefore, when the fastening portion 371 is in contact with the stopper 220 and the extension of the storage 300 is limited, the front end 372 of the extension limiting portion 370 located forwardly of the fastening portion 371 may be exposed to the outside of the detergent opening 15, and it may become easy for the user to press the front end 372 of the extension limiting portion 370.

The user may space the fastening portion 371 downwardly apart from the stopper 220 by pressing the front end 372 of the extension limiting portion 370 exposed forwardly of the detergent opening 15, and may completely extend and separate the storage 300 from the detergent opening 15 while releasing the extension restriction based on the set extension distance.

Referring to FIGS. 6 and 7, the cover 350 may further include a detergent cap 359 disposed to shield the detergent hole 358 defined in the cover base 353, and the detergent cap 359 may be located forwardly of the extension limiting portion 370.

The user may inject the detergent through the detergent hole 358 without removing the cover 350 when supplying the detergent to the detergent storage space shielded by the cover 350. When the detergent hole 358 is kept open, the detergent may leak, so that the detergent hole 358 may be shielded by the detergent cap 359. In addition, in order to inject the detergent by extending the storage 300 by only a distance required for the detergent injection without completely extending the storage 300, the detergent hole 358 and the detergent cap 359 may be located forwardly of the extension limiting portion 370.

As an example of supplying the detergent to the storage 300, the user may extend the storage 300 by the predetermined distance limited by the extension limiting portion 370, then inject the detergent by opening the detergent cap 359 exposed to the user, and then recouple the detergent cap 359 and re-retract the storage 300.

In the use with the same process as above, the user may significantly reduce a frequency of removing the cover 350 from the storage frame 310. Accordingly, a frequency of the user's manipulation of the cover handle 357 is also reduced, so that the detergent may be easily injected into the detergent storage space S while the cover handle 357 is disposed rearwardly of the extension limiting portion 370 to prevent the detergent from leaking as the cover 350 is unintentionally removed.

Referring to FIGS. 6 to 8, a fastening elastic portion 210 disposed in the cabinet 10 and positioned above the storage frame 310, and protruding toward the storage frame 310, and a fastening protrusion 360 disposed in the storage frame 310 and protruding upward, and in contact with the fastening elastic portion 210 in the extension process of the storage 300 may be further included.

The fastening elastic portion 210 may be formed in the dispenser assembly 200 disposed on top of the storage frame 310. The dispenser assembly 200 may serve as the fixing assembly.

The fastening elastic portion 210 may be made of a deformable material or may be formed to be movable within a limited position range. The fastening elastic portion 210 may be constructed to be in contact with the fastening protrusion 360 disposed in the storage frame 310 in the retraction and extension process of the storage 300.

The fastening elastic portion 210 may be deformed or moved a predetermined distance by being pressed by the fastening protrusion 360. When the fastening elastic portion 210 is deformed by the fastening protrusion 360, an elastic force may be generated, and the fastening protrusion 360 may be pressed in a specific direction by the elastic force.

In the process of retracting the storage 300 into the cabinet 10, when the fastening protrusion 360 comes into contact with the fastening elastic portion 210, and the fastening elastic portion 210 is deformed to generate the elastic force, the user gripping the handle 305 of the storage 300 may sense the corresponding elastic force. When the retraction of the storage 300 is completed and the storage 300 is retracted by a maximum retractable distance, the elastic force may disappear. In this case, the user may sense that the storage 300 is disposed at an appropriate location.

When the storage 300 is not sufficiently retracted, the detergent may not be smoothly supplied during the operation process of the laundry treating apparatus 1. Because the user may sense whether the storage 300 is properly retracted by the fastening protrusion 360 and the fastening elastic portion 210, it is easy to couple the storage 300 to a correct position.

A protruding shape of the fastening elastic portion 210 may be varied as needed. For example, the fastening protrusion 360 and the fastening elastic portion 210 may have a shape in which a center thereof protrudes so as to have a gentle inclination from a front portion and a rear portion thereof.

The fastening elastic portion 210 may be made of a material that has elasticity and is able to be deformed and restored, and may have greater elasticity than the fastening protrusion 360. In addition, the fastening elastic portion 210 may have greater elasticity than a material of the fixing assembly.

The fastening elastic portion 210 may be disposed such that at least a portion thereof, for example, a portion including an end protruding downward, overlaps the fastening protrusion 360 along the front and rear direction or the retraction direction of the storage 300.

The storage 300 may be extended such that the fastening protrusion 360 is located forwardly of the fastening elastic portion 210, and the fastening protrusion 360 may be moved rearward toward the fastening elastic portion 210 during the retraction process. The fastening protrusion 360 may be moved rearward to overlap the fastening elastic portion 210 in a vertical direction.

In the retraction process of the storage 300, the fastening protrusion 360 may be moved rearward while passing the fastening elastic portion 210. That is, the fastening elastic portion 210 may be positioned to overlap the fastening protrusion 360 in the vertical direction, and be pressed and deformed by the fastening protrusion 360. The fastening elastic portion 210 pressed by the fastening protrusion 360 may be deformed to lower a protruding height thereof. Accordingly, the fastening protrusion 360 may be moved rearward past the fastening elastic portion 210.

When the storage 300 is fully retracted into the detergent opening 15, the fastening protrusion 360 may be located rearwardly of the fastening elastic portion 210. The fastening elastic portion 210 may be pressurized and deformed by the fastening protrusion 360 in the state in which the storage 300 is fully retracted, and may press the fastening protrusion 360 rearward with a reaction force. However, the present disclosure may not be limited thereto, and the contact thereof with the fastening protrusion 360 may be released when the storage 300 is fully retracted.

The user may extend the storage 300 from the detergent opening 15 using the handle 305, and put the detergent into the storage 300. The storage 300 in which the detergent is stored may slide and is retracted into the detergent opening 15 again. At this time, the user may be aware of the retraction situation of the storage 300 through the contact relationship between the fastening protrusion 360 and the fastening elastic portion 210.

For example, in the process of gripping the handle 305 and retracting the storage 300 rearward, the user may recognize the contact between the fastening protrusion 360 and the fastening elastic portion 210, and may receive a predetermined pressure. At the same time when a maximum protrusion point 366 of the fastening protrusion 360 passes a maximum protrusion point 211 of the fastening elastic portion 210, the pressure delivered to the user may be reduced, and the user may recognize a degree of retraction of the storage 300.

In addition, the deformed fastening elastic portion 210 may press the fastening protrusion 360 rearward while being restored. As such, when the fastening protrusion 360 is pressed by the fastening elastic portion 210, the storage 300 may naturally move rearward.

As described above, during the retraction process of the storage 300, the user may feel that a reaction force in a direction opposite to the retraction direction increases, and may recognize that a force in the same direction as the retraction direction is applied after a certain moment. That is, because the storage 300 may be retracted by the fastening elastic portion 210 even when the user applies a small force after the specific moment, there is an effect of increasing the user convenience.

In one example, at least a portion of the fastening elastic portion 210 may be detachably coupled to the fixing assembly. Specifically, the fastening elastic portion 210 may be manufactured separately from the fixing assembly, and at least a portion thereof may be coupled to the fixing assembly. In this connection, the fastening elastic portion 210 may be detachably coupled to the fixing assembly.

The fastening elastic portion 210 may correspond to an elastic body that is deformed by being pressed by the fastening protrusion 360 and restored. It may be advantageous that the fastening elastic portion 210 is easier to be deformed than the material of the fixing assembly and has excellent elasticity. In one embodiment of the present disclosure, such fastening elastic portion 210 is manufactured separately from the fixing assembly, so that the fastening elastic portion 210 may be manufactured using a material different from that of the fixing assembly with high rigidity.

In addition, the manufacturing of the fixing assembly may include a heat treatment process. In this case, the material constituting the fixing assembly may decrease in the elasticity and increase in the rigidity after the heat treatment. When molding the fastening elastic portion 210 together with the fixing assembly, the fastening elastic portion 210 may also have decrease in the elasticity by the heat treatment process.

That is, one embodiment of the present disclosure manufactures the fastening elastic portion 210 separately from the fixing assembly and detachably couple the fastening elastic portion 210 to the fixing assembly, which is advantageous because it is possible to avoid a change in properties of the material resulted from a series of molding processes included in the manufacturing of the fixing assembly.

The fastening protrusion 360 may be disposed on the rear partition wall 342. Specifically, the fastening protrusion 360 may be positioned between the first seat portion 321 and the second seat portion 322. Because an additional structure is not required to form the fastening protrusion 360, and the space of the storage frame 310 is able to be efficiently used, there is an effect of increasing the capacity of stored detergent.

Referring to FIGS. 6 and 7 again, the cover 350 of the laundry treating apparatus according to an embodiment of the present disclosure may include a cover base 353 disposed in parallel with the frame bottom surface 311 to shield the open top surface of the detergent storage space, and a cover coupling portion 354 extending along a perimeter of the cover base 353 and including a coupling insertion portion into which the cover seat portion 320 is inserted.

Preferably, the cover base 353 shields the open top surfaces of the first storage space S1 and the second storage space S2. Preferably, the cover base has a larger area than a surface formed by the cover seat portion 320 in order to shield the open top surface.

A cover coupling portion 354 formed to be coupled to the cover seat portion 320 may be disposed along the perimeter of the cover base 353. The cover coupling portion 354 may have the coupling insertion portion that is recessed upwardly. With a scheme in which the cover seat portion 320 is inserted into the coupling insertion portion, the cover 350 may shield the open top surface of the detergent storage space S.

The coupling insertion portion may be formed in a shape corresponding to the cover seat portion 320. The coupling insertion portion 3541 may be in contact with the cover seat portion 320 on several surfaces to increase a contact frictional force, and may increase a bonding strength of the cover 350 to prevent a situation in which the cover 350 is unintentionally removed and the detergent stored in the first storage space S1 or the second storage space S2 leaks.

The storage frame 310 may have the front outer wall 331 disposed on the front surface thereof, the rear outer wall 332 disposed on the rear surface thereof, and the first side outer wall 333 and the second side outer wall 334 respectively disposed on the both side surfaces thereof.

The cover coupling portion 354 may further include a cover handle 357 extending in a direction away from the frame partition wall 340 from a portion coupled to the first side outer wall 333 or the second side outer wall 334.

The user may easily remove the cover 350 by gripping the cover handle 357 when removing the cover 350 from the storage frame 310. Because the cover handle 357 protrudes from the side surface of the storage frame 310 and is exposed to the outside, the user may grip the cover handle 357 without being disturbed by other structures.

Each of the first side outer wall 333 and the second side outer wall may include a coupling rib 335 protruding laterally to support the cover coupling portion 354. In addition, the cover handle 357 may be disposed to be spaced apart from the coupling rib 335.

The coupling rib 335 may extend from each of the first side outer wall 333 and the second side outer wall 334 in the direction away from the frame partition wall 340. The coupling rib 335 may have a length smaller than a length in the front and rear direction of the first side outer wall 333 or the second side outer wall 334.

The coupling rib 335 may extend laterally from one point of the first side outer wall 333 or the second side outer wall 334 where the cover seat portion 320 is formed so as to be in contact with the cover coupling portion 354. When the cover seat portion 320 is inserted into the coupling insertion portion 3541 of the cover coupling portion 354, a bottom of the cover coupling portion 354 may be supported by being in contact with the coupling rib 335.

When the cover coupling portion 354 is supported on the coupling rib 335, it is possible to reduce deformation resulted from bending applied to the cover seat portion 320 in the process of detaching the cover 350. In addition, because a contact area with the storage frame 310 is increased when the cover 350 is coupled, the cover 350 may be coupled more stably. That is, the situation in which the cover 350 is unintentionally removed from the storage frame 310 and the detergent leaks may be prevented.

When the coupling rib 335 is extended to be in contact with the cover handle 357, a space for the user to grip the cover handle 357 may be reduced. Therefore, even when the coupling rib 335 extends along the first side outer wall 333 or the second side outer wall 334, the coupling rib 335 may extend apart from the cover handle 357.

In order for the coupling rib 335 and the cover handle 357 to be spaced apart from each other, the cover 350 may be manufactured such that the coupling rib 335 is not formed on a portion where the cover handle 357 is disposed when the cover 350 is coupled.

Preferably, the cover handle 357 may be formed to protrude from the cover coupling portion 354 so as to be located at a rear portion of the first side outer wall 333 or the second side outer wall 334, and the coupling rib 335 may extend from a front portion of the first side outer wall 333 or the second side outer wall 334 to a point right ahead of a point at which the cover handle 357 is disposed.

When the cover handle 357 and the coupling rib 335 are formed to be spaced apart from each other as described above, a coupling force of the cover 350 may be strengthened by the coupling rib 335, and stability of the storage frame 310 may be increased, and at the same time, the user may easily remove the cover 350 from the storage frame 310 by gripping the cover handle 357.

The stopper 220 and the extension limiting portion 370 may prevent an accident in which the storage 300 is unintentionally detached and dropped while the user supplies the detergent or manipulates the storage 300.

The cover handle 357 may be formed rearwardly of the extension limiting portion 370. The cover handle 357 is formed on the cover coupling portion 354. When the cover handle 357 is formed to be easily gripped in the state in which a portion of the storage 300 is extended, unlike an intention of the user, the cover may be removed from the storage frame 310 and the detergent may leak.

When being extended by the predetermined distance by the extension limiting portion 370, the storage 300 may not be completely removed from the cabinet 10 without additional manipulation of the extension limiting portion 370. That is, a portion of the storage 300 is accommodated inside the cabinet 10 in a general use environment.

When the cover handle 357 is formed rearwardly of the extension limiting portion 370, it may be difficult for the user to access the cover handle 357 without manipulating the extension limiting portion 370. Therefore, it is possible to prevent a situation in which the cover handle 357 is arbitrarily manipulated to remove the cover 350 and the detergent leaks.

Referring back to FIG. 10, the fixing assembly may include a sliding coupling portion 213 to which one end of the fastening elastic portion 210 is slidably coupled, and a sliding limiting portion 214 constructed to limit a sliding distance of said one end.

In addition, the sliding limiting portion 214 may be positioned to face said one end of the fastening elastic portion 210, and come into contact with said one end of the sliding fastening elastic portion 210 to limit the sliding distance of said one end.

When one of both ends of the fastening elastic portion 210 is constructed to be slidable, an amount of deformation of the fastening elastic portion 210 may be reduced in the process of retraction and extension of the storage 300. As the amount of deformation of the fastening elastic portion 210 increases, the elastic force of the fastening elastic portion 210 may decrease because of the repeated deformation. Therefore, when one end of the fastening elastic portion 210 is slidably coupled to the sliding coupling portion 213, the decrease in the elastic force of the fastening elastic portion 210 may be prevented. Therefore, there is an effect of increasing the durability of the fastening elastic portion 210.

However, when one end of the fastening elastic portion 210 is excessively slid, the storage 300 may not sufficiently support the fastening protrusion 360 in the fully retracted state. Therefore, the sliding limiting portion 214 that limits the distance that said one end of the fastening elastic portion 210 moves for the fastening elastic portion 210 to support the fastening protrusion 360 when the storage 300 is fully retracted may be further included.

When the sliding coupling portion 213 and the sliding limiting portion 214 are constructed, the storage 300 may be more easily retracted and extended, and the storage 300 may be sufficiently supported while improving the durability of the fastening elastic portion 210.

As such, accuracy of the detecting sensor 390 may be improved by the sensor rib 392, and the detecting sensor 390 may be disposed in each of the first storage space S1 and the second storage space S2 to inform the user of a detergent supply required time. Accordingly, there is an effect of increasing the user convenience.

Although the present disclosure has been illustrated and described in relation to a specific embodiment, within the limits that do not depart from the technical spirit of the present disclosure provided by the following claims, it will be apparent to those of ordinary skill in the art that the present disclosure may be variously improved and changed.

What is claimed is:

1. A laundry treating apparatus comprising:

a cabinet;

a tub located inside the cabinet and configured to receive wash water;

a drum rotatably disposed inside the tub and configured to receive laundry;

a detergent storage configured to be inserted into the cabinet rearwardly and withdrawn from the cabinet forwardly, the detergent storage comprising a storage frame that defines a detergent storage space configured to store detergent to be supplied to the tub; and a fixing assembly disposed inside the cabinet and configured to face the detergent storage, the fixing assembly comprising a fastening elastic portion that protrudes toward the detergent storage, wherein the storage frame comprises:

a frame outer wall that defines an outer wall of the storage frame and surrounds the detergent storage space, and a frame partition wall that is disposed in the storage frame and partitions the detergent storage space into a plurality of storage spaces, the frame partition wall comprising a fastening protrusion that protrudes toward the fixing assembly and is configured to press and deform the fastening elastic portion based on the detergent storage being inserted into and withdrawn from the cabinet, wherein the frame outer wall comprises:

a front outer wall disposed at a front side of the storage frame, and a rear outer wall disposed at a rear side of the storage frame opposite to the front side of the storage frame, and wherein the frame partition wall connects the front outer wall and the rear outer wall to each other.

2. The laundry treating apparatus of claim 1, wherein the frame partition wall comprises:

an auxiliary storage partition wall that is spaced apart from each of the front outer wall and the rear outer wall and surrounds a portion of the detergent storage space;

a front partition wall that connects the front outer wall to the auxiliary storage partition wall; and a rear partition wall that connects the rear outer wall to the auxiliary storage partition wall, and wherein the fastening protrusion is disposed at the rear partition wall.

3. The laundry treating apparatus of claim 2, wherein a rear end of the fastening protrusion is connected to the rear outer wall.

4. The laundry treating apparatus of claim 2, wherein the fastening protrusion comprises:

a front contact portion disposed at a front portion of the fastening protrusion, the front contact portion defining an inclined surface that extends from a front end of the front contact portion to a rear end of the front contact portion disposed higher than the front end of the front contact portion;

a rear contact portion that is disposed at a rear portion of the fastening protrusion and protrudes toward the fastening elastic portion, the rear contact portion being configured to be in contact with the fastening elastic portion; and a connecting portion that connects the front contact portion to the rear contact portion and defines a maximum protrusion point of the fastening protrusion protruding toward the fixing assembly.

5. The laundry treating apparatus of claim 4, wherein a lowermost portion of the fastening elastic portion protrudes toward the detergent storage and is configured to, based on the detergent storage being inserted to a fully inserted position in the cabinet, be located forward relative to the connecting portion and support the fastening protrusion.

6. The laundry treating apparatus of claim 4, wherein the rear contact portion comprises a horizontal extension section that has a uniform height protruding from the rear partition wall and that extends along a longitudinal direction of the fastening protrusion.

7. The laundry treating apparatus of claim 4, wherein a rear surface of the rear contact portion extends from a rear surface of the rear outer wall.

8. The laundry treating apparatus of claim 2, wherein the frame outer wall further comprises a first side outer wall and a second side outer wall that connect the front outer wall and the rear outer wall to each other, and wherein the plurality of storage spaces comprise:

a first storage space defined between the first side outer wall and the frame partition wall;

a second storage space defined between the second side outer wall and the frame partition wall; and a third storage space surrounded by the auxiliary storage partition wall.

9. The laundry treating apparatus of claim 8, further comprising:

a first cover configured to cover a first open top surface of the first storage space;

a second cover configured to cover a second open top surface of the second storage space;

a first seat portion that extends along a first perimeter of the first storage space and is configured to couple to the first cover; and a second seat portion that extends along a second perimeter of the second storage space and is configured to couple to the second cover.

10. The laundry treating apparatus of claim 9, wherein the first seat portion and the second seat portion are spaced apart from each other and extend along the rear partition wall, and wherein the fastening protrusion is located between the first seat portion and the second seat portion.

11. The laundry treating apparatus of claim 9, wherein the first seat portion and the second seat portion are spaced apart from each other, each of the first seat portion and the second seat portion extending along the front partition wall and the rear partition wall, and wherein a first spacing distance between the first seat portion and the second seat portion at the rear partition wall is greater than a second spacing distance between the first seat portion and the second seat portion at the front partition wall.

12. The laundry treating apparatus of claim 10, wherein a lowermost portion of the fastening elastic portion is configured to be located between the first cover and the second cover based on the detergent storage being inserted to a fully inserted position in the cabinet.

13. The laundry treating apparatus of claim 1, wherein the fixing assembly further comprises a stopper that is spaced apart from the fastening elastic portion and that protrudes toward the storage frame, and wherein the detergent storage further comprises an extension limiting portion disposed at the frame partition wall and configured to contact the stopper to thereby limit an extension distance of the detergent storage withdrawn from the cabinet.

14. The laundry treating apparatus of claim 13, wherein the extension limiting portion is located forward relative to the fastening protrusion.

15. The laundry treating apparatus of claim 13, wherein the extension limiting portion and the fastening protrusion are laterally offset from each other such that the extension limiting portion and the fastening protrusion do not overlap with each other along a front-rear direction of the detergent storage.

16. The laundry treating apparatus of claim 1, wherein the fixing assembly comprises:

a sliding coupling portion, wherein an end part of the fastening elastic portion is slidably coupled to the sliding coupling portion; and a sliding limiting portion configured to limit a sliding distance of the fastening elastic portion.

17. The laundry treating apparatus of claim 16, wherein the sliding limiting portion is configured to face and contact the end part of the fastening elastic portion to thereby limit the sliding distance of the fastening elastic portion.

18. The laundry treating apparatus of claim 16, wherein the sliding coupling portion defines a space that receives the end part of the fastening elastic portion, and wherein the sliding limiting portion comprises a protrusion spaced apart from the sliding coupling portion.

19. The laundry treating apparatus of claim 1, wherein the fastening elastic portion comprises a strip that is curved downward and configured to interfere with the fastening protrusion based on the detergent storage being inserted into and withdrawn from the cabinet.

20. The laundry treating apparatus of claim 1, wherein the cabinet defines a detergent opening at a front surface thereof, and wherein the detergent storage configured to be inserted into and withdrawn from the cabinet through the detergent opening of the cabinet.

* * * * *